US006829882B2

(12) United States Patent
Chia et al.

(10) Patent No.: US 6,829,882 B2
(45) Date of Patent: Dec. 14, 2004

(54) ORNAMENTAL JEWELRY ROPE CHAIN LINK ELEMENT

(76) Inventors: Meang K. Chia, 412 W. 6th St., Suite 1104, Los Angeles, CA (US) 90014; Cheo K. Chia, 412 W. 6th St., Suite 1104, Los Angeles, CA (US) 90014; Huy K. Chia, 412 W. 6th St., Suite 1104, Los Angeles, CA (US) 90014

( * ) Notice: Subject to any disclaimer, the term of this patent is extended or adjusted under 35 U.S.C. 154(b) by 0 days.

(21) Appl. No.: 10/302,677

(22) Filed: Nov. 22, 2002

(65) Prior Publication Data

US 2003/0074880 A1 Apr. 24, 2003

Related U.S. Application Data

(60) Division of application No. 09/528,820, filed on Mar. 20, 2000, now Pat. No. 6,532,725, which is a continuation-in-part of application No. 09/337,455, filed on Jun. 21, 1999, now Pat. No. 6,560,955, which is a continuation-in-part of application No. 09/287,972, filed on Apr. 7, 1999, now Pat. No. 6,209,306.

(51) Int. Cl.[7] ..... F16G 13/00; B21L 11/00

(52) U.S. Cl. ..... 59/80; 59/82; 59/3

(58) Field of Search ..... 59/3, 35.1, 80, 59/82; D11/13

(56) References Cited

U.S. PATENT DOCUMENTS

| | | | |
|---|---|---|---|
| 848,299 | A | 3/1907 | Feid |
| 1,055,751 | A | 3/1913 | Hurley |
| 1,886,784 | A | 11/1932 | Boppenhausen |

(List continued on next page.)

FOREIGN PATENT DOCUMENTS

| | | |
|---|---|---|
| DE | 43 24 387 A1 | 1/1995 |
| EP | 0 470 937 A1 | 7/1991 |
| FR | 2 446 612 | 9/1980 |
| GB | 2 279 227 A | 1/1995 |
| IL | 15948 | 1/1990 |

OTHER PUBLICATIONS

All Karats International, Edizioni, Primavera–Estate/*Spring–Summer*, Sixth Edition, Two–tone Diamond Cut Rope Chain; 2 pages (1998).

Armbrust Chain Company; Providence, Rhode Island; pp. 15, 145, 151, 188 (1975).

Aurora s.r.l.; Vicenza; gold bracelet, necklace, earrings; p. 25 (1997).

Bisarello Pietro S.r.l.; Cavazzale (Vicenza) Italy; untitled page and p. 29 (1971).

Chrysos S.r.l.; (Treviso), Italy; cover page.

Empress Rope Chain, A.K.S. International; New York; 2 pages.

Fancy Jewelry Imports; Los Angeles, CA; p. 45.

Filk SPA–Catene; via S. Giuseppe; (Vicenza) Italy, *763 VI; p. B 05, B 19 BIS, A 18, B 21.

(List continued on next page.)

*Primary Examiner*—David B Jones
(74) *Attorney, Agent, or Firm*—Ladas & Parry LLP

(57) ABSTRACT

Rope chain link elements and a manufacturing process to make such link elements, each link element exhibiting a unique visual property, such as coloration, surface texture, reflectivity, design feature or characteristic, shape, or other visually attractive appearance. Methods of construction include surface pre-texturing, stamping, simultaneous surface texturing and stamping, and wire bending. Such unique visual property traits for the succession of link elements results in a more attractive, fanciful, more delicate and interesting fashion item. Each of the interconnected link elements may have the same or different visual properties, and may have multiple portions of varying color, texture, or other visual properties. In other aspects of the invention, each link element may have differently shaped portions, such as adjoining and connecting geometric or heart shaped segments. Additionally, the interior and/or exterior edges of the link element may exhibit different shapes, colors, patterns, or textures.

5 Claims, 19 Drawing Sheets

U.S. PATENT DOCUMENTS

| | | | |
|---|---|---|---|
| 4,348,861 | A | 9/1982 | Nakagawa |
| 4,493,183 | A | 1/1985 | Bucefari et al. |
| 4,651,517 | A | 3/1987 | Benhamou et al. |
| 4,679,391 | A | 7/1987 | Tizzi |
| 4,934,135 | A | 6/1990 | Rozenwasser |
| D313,372 | S | 1/1991 | Kulla |
| D313,771 | S | 1/1991 | Kulla |
| 4,996,835 | A | 3/1991 | Rozenwasser |
| D321,148 | S | 10/1991 | Chiaramonti et al. |
| D326,065 | S | 5/1992 | Borgogni |
| 5,125,225 | A | 6/1992 | Strobel |
| 5,129,220 | A | 7/1992 | Strobel |
| D329,828 | S | 9/1992 | Bedoyan |
| D330,175 | S | 10/1992 | Kahan |
| D330,343 | S | 10/1992 | Bedoyan |
| 5,185,995 | A | 2/1993 | Dal Monte |
| D335,834 | S | 5/1993 | Grotto |
| D340,422 | S | 10/1993 | Grando |
| D343,136 | S | 1/1994 | Grando |
| D343,806 | S | 2/1994 | Bedoyan |
| 5,285,625 | A | 2/1994 | Ofrat et al. |
| 5,301,498 | A | 4/1994 | Chia et al. |
| 5,303,540 | A | 4/1994 | Rozenwasser |
| 5,309,704 | A | 5/1994 | Grando |
| 5,339,655 | A | 8/1994 | Grando |
| 5,353,584 | A | 10/1994 | Strobel et al. |
| 5,361,575 | A | 11/1994 | Rozenwasser |
| D353,556 | S | 12/1994 | Chia et al. |
| 5,408,820 | A | 4/1995 | Strobel et al. |
| 5,412,935 | A | 5/1995 | Rozenwasser |
| D359,010 | S | 6/1995 | Rozenwasser |
| 5,425,228 | A | 6/1995 | Hillel |
| 5,437,149 | A | 8/1995 | Strobel |
| D362,203 | S | 9/1995 | Grando |
| 5,452,572 | A | 9/1995 | Alvaro et al. |
| 5,471,830 | A | 12/1995 | Gonzales |
| 5,487,264 | A | 1/1996 | Strobel |
| D368,048 | S | 3/1996 | Rozenwasser |
| D370,184 | S | 5/1996 | Rozenwasser |
| D370,426 | S | 6/1996 | Rozenwasser |
| 5,526,639 | A | 6/1996 | Gonzales |
| 5,531,065 | A | 7/1996 | Rozenwasser |
| 5,537,812 | A | 7/1996 | Rozenwasser |
| 5,542,244 | A | 8/1996 | Chia et al. |
| 5,544,477 | A | 8/1996 | Rozenswasser |
| D376,119 | S | 12/1996 | Rozenwasser |
| 5,581,993 | A | 12/1996 | Strobel |
| 5,626,012 | A | 5/1997 | Fabbro |
| 5,653,100 | A | 8/1997 | Dal Monte |
| 5,660,036 | A | 8/1997 | Rozenwasser |
| 5,682,736 | A | 11/1997 | Chia et al. |
| 5,775,088 | A | 7/1998 | Grosz |
| 5,797,258 | A | 8/1998 | Strobel et al. |
| D398,551 | S | 9/1998 | Kupelian |
| 5,911,677 | A | 6/1999 | Kupelian |
| D424,964 | S | 5/2000 | Chia et al. |
| 6,209,306 | B1 | 4/2001 | Chia et al. |
| 6,481,196 | B1 * | 11/2002 | Chia et al. ..... 59/80 |
| 6,532,725 | B1 * | 3/2003 | Chia et al. ..... 59/35.1 |
| 6,560,955 | B1 * | 5/2003 | Chia et al. ..... 59/80 |

OTHER PUBLICATIONS

Istor; Nuruosmaniye Vezirhan Cd. No: 64 Cemberlitas–istambul/Turkey; p. 22.

*JO Magazine*; "Images From our exciting new collection"; 3 pages total.

K Mart, Item #76617103508, Sterling Silver Two–tone Solid Diamond Cut Rope Chain; 3 pages.

Leslie's Jewelry at New York, vol. 698; Item 203–3/2.9/Bi–Color; p. 65.

*L'Oromeccanica Catalog*, L'Oromeccanica SPA; Via Marchesane 115A/36061 Bassano Del Grappa (Vicenza) Italy; cover page, p. 36, 44, 50, one page (1982).

QVC, Item #J64656, 36" Two–tone Solid Rope Necklace, 14K Gold 7.5 grams; 2 pages.

Solid Gold Bracelets, p. 7.

Steven Kretchmer Design; Palenville, NY; 1 page.

Wards D45–9738400, 17" Rope Chain Necklace; #45–9738301, 7" and 18" Rope Chain Bracelet and Necklace; 3 pages.

* cited by examiner

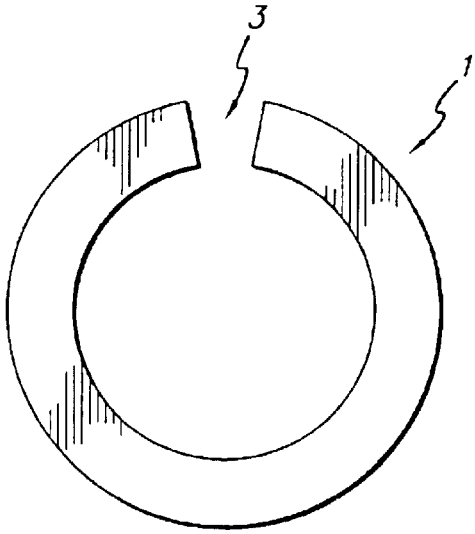
FIG. 1
PRIOR ART
FIG. 2
PRIOR ART
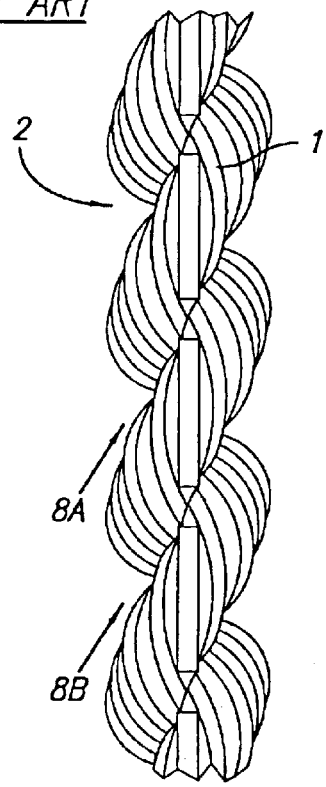
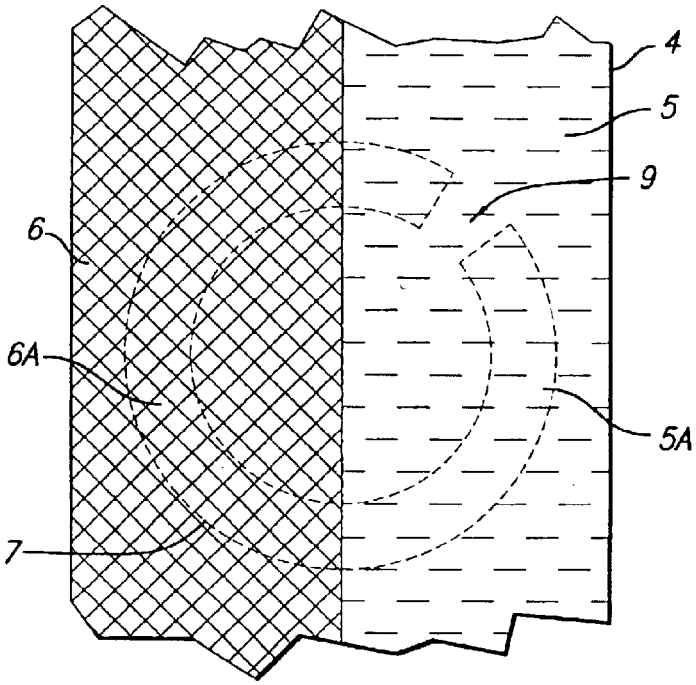
FIG. 3

FIG. 14
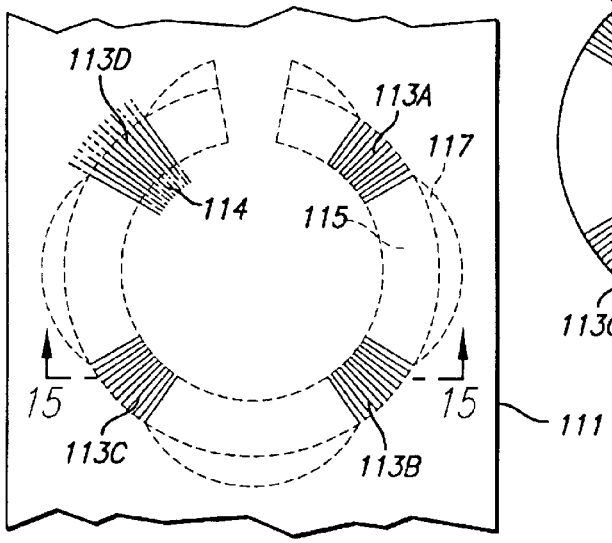
FIG. 16
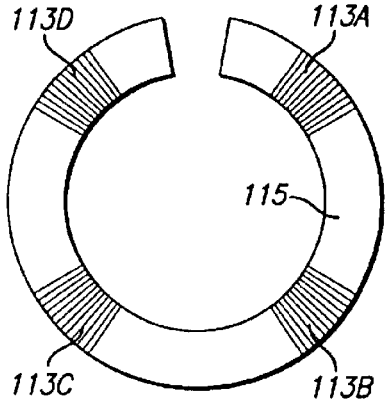
FIG. 17
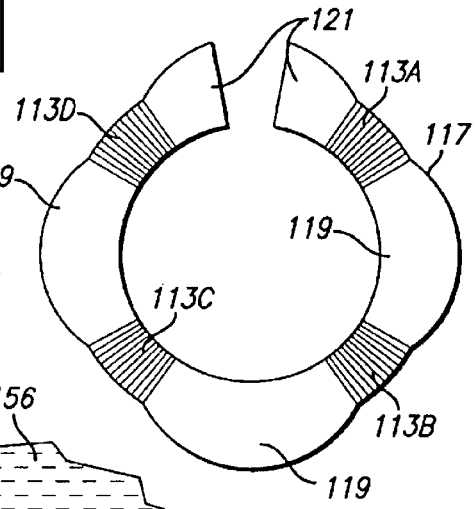
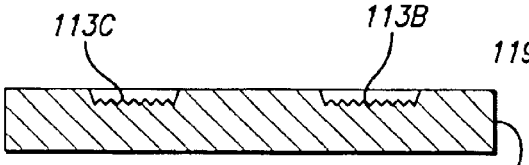
FIG. 15
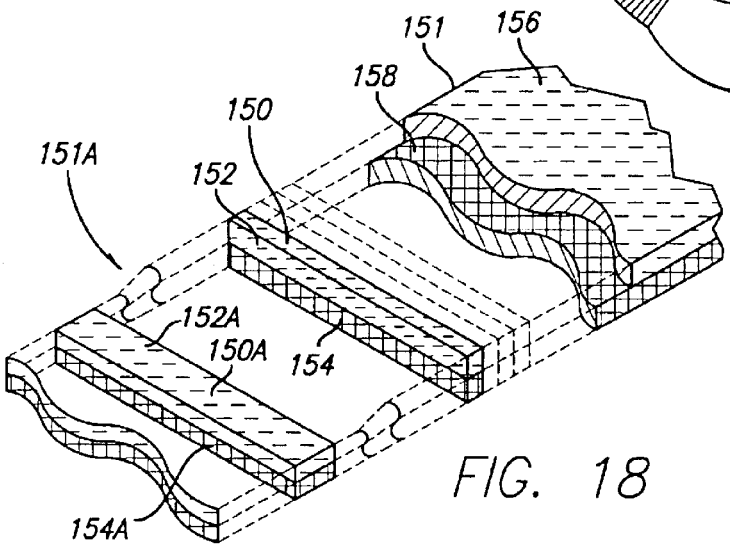
FIG. 18

131
133
135
137
138
139
141
145
146
147
147A
149
153
22
25

FIG. 70
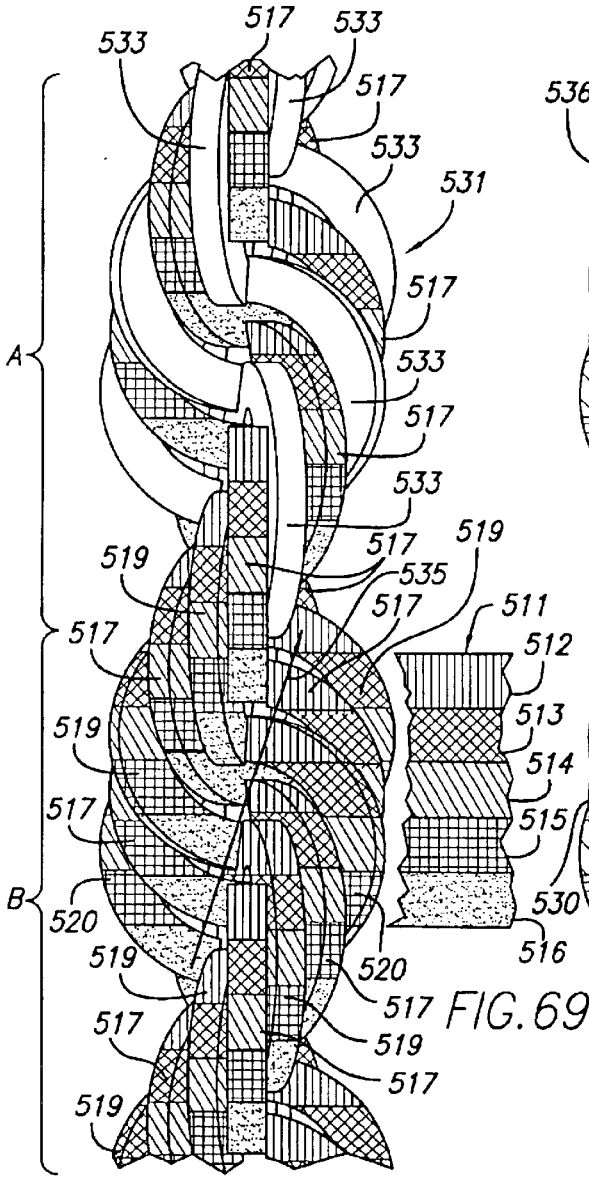
FIG. 69
FIG. 72
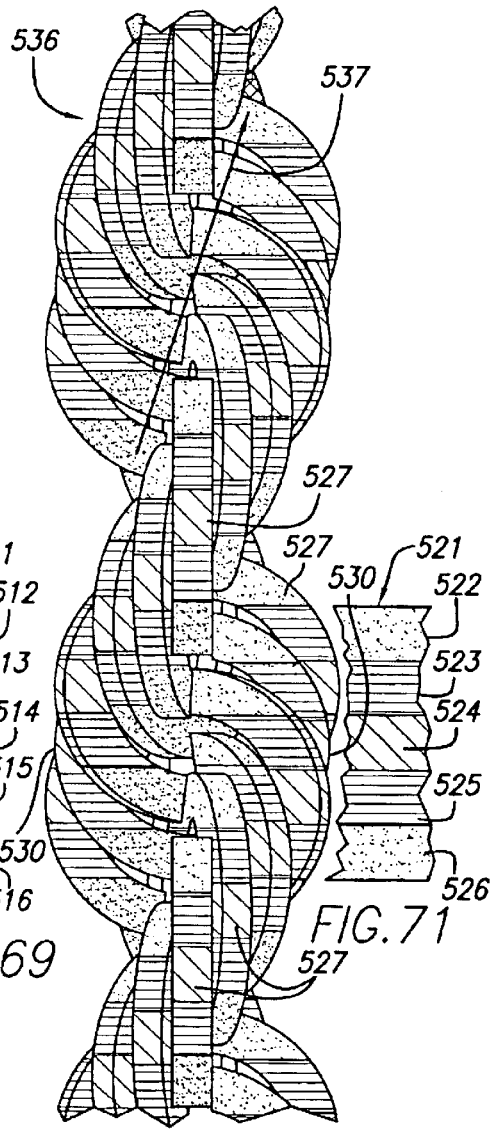
FIG. 71

FIG. 74
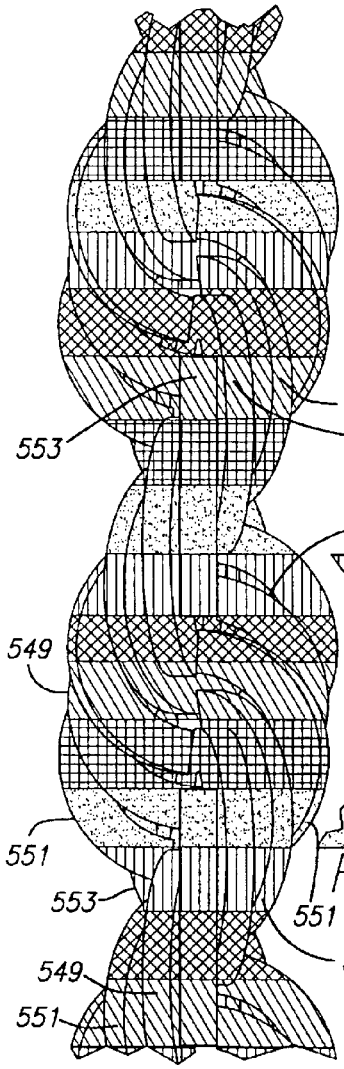
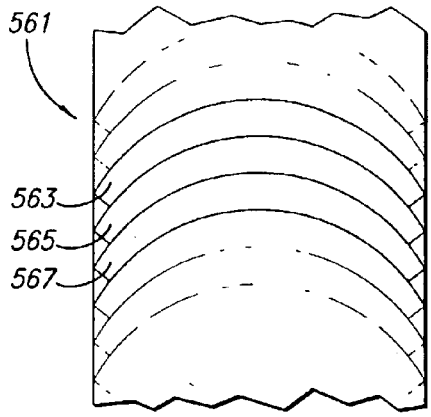
FIG. 76
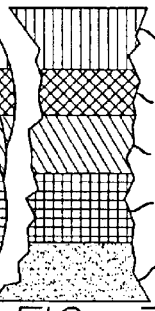
FIG. 73
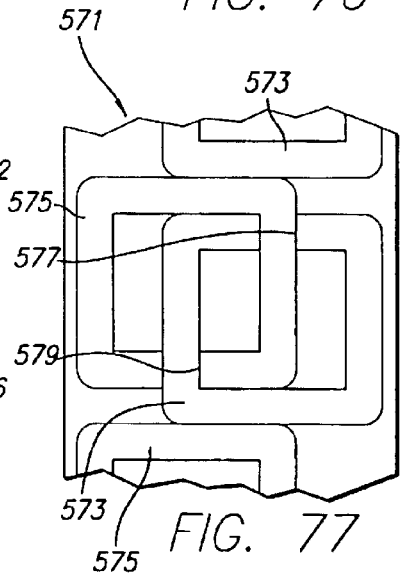
FIG. 77
FIG. 75
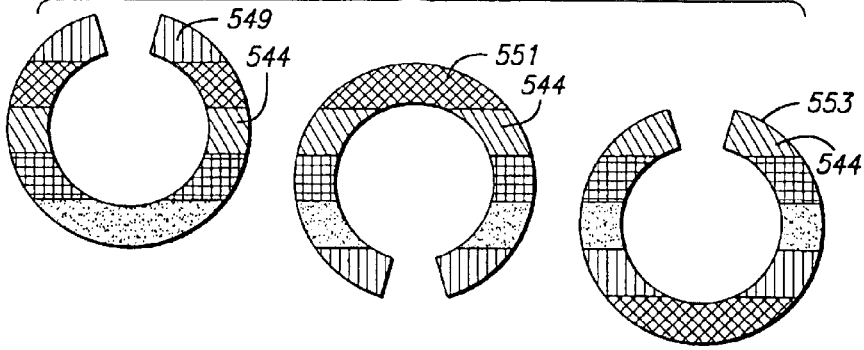

ORNAMENTAL JEWELRY ROPE CHAIN LINK ELEMENT

CROSS-REFERENCE TO RELATED APPLICATION

This application is a divisional of U.S. application Ser. No. 09/528,820, filed Mar. 20, 2000 now U.S. Pat. No. 6,532,725 which application is a continuation-in-part of application Ser. No. 09/337,455, filed Jun. 21, 1999, now U.S. Pat. No. 6,560,955 and entitled "JEWELRY ROPE CHAIN LINK ELEMENT", which is a continuation-in-part of application Ser. No. 09/287,972, filed Apr. 7, 1999, now U.S. Pat. No. 6,209,306 and entitled "DECORATIVE JEWELRY ROPE CHAIN", the entire contents of both applications incorporated herein by reference.

REFERENCE TO DOCUMENT DISCLOSURE CERTIFICATES

Reference is made to U.S. Document Disclosure Certificate Nos.: 449,115 recorded Dec. 22, 1998; 459911 recorded Jul. 30, 1999; 458876 recorded Jul. 5, 1999; 455008 recorded Apr. 19, 1999; and 455009 recorded Apr. 19, 1999; the entire contents of all such certificates incorporated herein by reference.

BACKGROUND OF THE INVENTION

1. Field of the Invention

This invention relates to the field of decorative jewelry items, and more particularly to the basic structural link element of a jewelry rope chain exhibiting attractive, decorative, and ornamental visual properties.

2. Brief Description of the Prior Art

Rope chains are a popular type of jewelry made from linking a number of standard sized annular link elements together in a repetitive manner and usually soldering, welding, or otherwise bonding every two link elements together. The result is a chain that is flexible and pleasing to the eye. The annular link elements are typically formed of gold, silver, or other precious metal and may be round in cross section or may be rectangular in cross section with flat major side surfaces, depending on the method of manufacture. The overall generally circular configuration of the annular link elements is not complete as there must be a gap provided to permit interlinking, i.e. interconnecting, of the link elements with each other. The result is a link element having a generally C-shaped configuration.

The generally C-shaped link elements are fastened together in a particular way, such that tightly interlinking annular link elements give the appearance of a pair of intertwining helical rope strands. A number of annular link elements are connected and intertwined together in a systematic and repetitive pattern of orientation, resulting in an eye-pleasing, flexible, and delicate-appearing chain that looks and feels like a finely braided double helix.

In a conventional rope chain, the orientation pattern of individual link elements making up the rope chain is repeated every several link elements, for example every four link elements, and as such, the chain is referred to as a four-link rope chain. In an improvement to the conventional basic rope chain, it is taught in U.S. Pat. No. 4,651,517 that the link elements can be constructed in different and narrower dimensions so that the pattern is repeated every six link elements or even every eight link elements.

In U.S. Pat. No. 5,301,498, to Chia et al., it is suggested that, by narrowing the cross-section of the link element, the six-link rope chain's connected segments appear finer than those of the four-link version and consequently provide a more delicate and refined presentation than that obtainable with a four-link rope chain arrangement. While the '517 patent uses a six-link rope chain as a preferred embodiment, that patent teaches the formulas for creating rope chains consisting of a repeated series of six, eight, or more link elements.

Some manufacturers of jewelry use different colored gold and silver elements to enhance the beauty of the jewelry article. Examples are: rope chains in which sets of link elements of one color alternate with sets of link elements of another color; and bracelets or necklaces constructed of interconnected twisted loops exhibiting alternating colors along their lengths. Gold, for example, is available in at least four colors; white, yellow, rose (pink), and green.

However, in typical prior art construction techniques for producing rope chain jewelry, each link element is of a single solid color, texture, shape, and pattern, e.g., each link element may be stamped from a solid thin sheet of precious metal, such as gold, in the form of an annular ring. While an all yellow gold rope chain or an all white gold rope chain is attractive, it is otherwise uninteresting due to the monotonic nature of its unvarying coloration, texture, and/or shape along the link elements of the chain. Those prior art rope chains that do exhibit variations of colors along their lengths nevertheless are constructed of individual link elements each of which is of a single solid color, texture, shape, and/or pattern.

Other chain-like jewelry articles exhibit variations of colors along their lengths using interconnected twisted loops, but they are not regarded as rope chains as defined herein.

Moreover, prior art link elements are generally C-shaped with a constant, typically rectangular cross section. As a result, a predictable visual effect is realized when the C-shaped link elements are assembled to simulate intertwined rope helixes. Additionally, after all of the link elements have been assembled into a finished rope chain jewelry item, a large percentage of the total volume of precious metal in each link element is forever hidden from view. That is, for the structural integrity of the rope chain, certain dimensional parameters have to be maintained, and there have been few attempts in the prior art of manufacturing rope chains to reduce the amount of precious metals being used, for fear of lessening or destroying the structural integrity of the finished product.

SUMMARY OF THE INVENTION

The present invention provides the means and methods for constructing rope chain link elements in a way to produce a rope chain piece of jewelry in which each link element, or selected link elements, and therefore the rope chain itself, exhibits unique visual properties.

By providing individual link elements with different visual properties, including different shapes, the ultimate appearance of the completed rope chain can be determined. For example, if each individual link exhibits two colors, the resulting rope chain will exhibit those two colors. Since the link elements overlap, and since they are placed in predetermined positions when they are interlinked, the location of the colors will have an influence on the appearance of the finished product.

Coloration is only one type of "visual property", and may vary according to the type or formulation of the material or materials from which a link element is made. Reflectivity, surface texture, pattern feature or characteristic, in addition to shape, are among other visual properties of a link that can influence the appearance of a finished rope chain. Such unique visual property traits for the succession of link elements results in a more attractive, fanciful, more delicate and interesting fashion jewelry item.

In addition to exhibiting unique visual properties, employing the concepts of the present invention, lengths of rope chains can be fabricated in which one of the apparent strands of "rope" has a different visual appearance than the intertwining "rope" strand. That is, the appearance of a rope strand at any point along the length of rope chain may not only be visually different than another point along the length of rope chain, but may also be visually different than the adjacent strand. For example, one strand may have an apparent smaller diameter than that of the adjacent strand. Or, the texture, coloration, surface reflectivity, pattern, shape, or other physical attribute of one strand may be totally distinct relative to the adjacent strand.

In accordance with one aspect of the present invention, the annular, or generally C-shaped, link elements may be formed by a stamping process whereby the desired visual effects on the link elements are preliminarily provided on the sheet of material from which the link elements are later stamped. Alternatively, especially when the visual property is surface texture or shape, the desired visual effects on the link elements may be created during or after the stamping process.

In accordance with another aspect of the invention, the annular, or generally C-shaped, link elements may be manufactured by bending a thin elongated wire of prescribed dimensions into the desired C-shape. The wire may be supplied on spools and formed by machine. For example, a Link-O-Matic® machine, such as the Model 534 available from Crafford Precision Products Co., One Industrial Court, Riverside, R. I. 02915, can feed, cut, and form a gapped, or non-gapped, link element each cycle of operation. The wire may undergo a preliminary surface texturing process, such as serrating, prior to being cut and formed into a link element by the machine, or the machine can form the link element and a subsequent surface texturing and/or coloration process may be employed.

The sheet of material may be fabricated from one or more species of the same substance (e.g., gold) or from a combination of substances (e.g., gold and silver). A first portion of the sheet may have a first visual property, and a second portion of the sheet may have a second visual property. Again, the visual property may be the result of coloration, reflectivity, surface texture, pattern feature or characteristic, or shape, or other visual property attribute that provides one portion of the resulting link with a different appearance than another portion of the link.

Importantly, as will be described in detail hereinafter, in the stamping process, in addition to die-cutting the outline for the overall generally C-shaped configured link elements from the sheet of material provided, the die tools or devices may be fabricated to impress, on one or more of the major or side edge surfaces of the link element being die-cut, a surface texture or shape. That is, any surface or surface portion of the stamped link element may exhibit a desired surface texture or shape produced by an impression on, in, or to that surface by the tooling or device employed by the stamping process, effectively imprinting a desired shape, form, or finish.

Portions of a link element may also be shaped by the die-cutting action of the stamping machine.

As indicated, surface texturing may precede or follow the stamping process. However, simultaneous die-cutting and surface texturing is more efficient and is preferred.

After a link element is die-cut from the sheet of material, a subsequent pressure stamping process may be employed to impress designs or patterns on the side edges of the link element.

By interconnecting together a plurality of link elements made in accordance with the invention, a rope chain can be manufactured that exhibits visual properties in a distinctive and decorative pattern. Intermixing link elements exhibiting different visual properties in a particular sequence during assembly of the rope chain can likewise produce visually pleasing lengths of rope chain.

In the process of altering the physical shape of the individual link elements, simultaneously with the enhancement of the visual effect due to the texturing and/or shape altering techniques, small amounts of the precious metal making up the link elements are removed without reducing the effective dimensional characteristics of the elements and, therefore, without diminishing the structural integrity of the finished rope chain product.

Several examples of impressing lines (simulating scoring), serrations, depressions, and other patterns or designs are described in this specification. It should be appreciated that when impressions are made in a soft material, such as gold, during a pressure stamping process, there exists a physical displacement of the material previously occupying the depressed area. Thus, whatever material is pushed out of the depressed area moves to the adjacent regions, thereby making the thickness of the link element greater at such adjacent regions. This is significant, since a thinner sheet of material, at less cost, can be provided. For example, when creating a serrated major surface on a link element being pressure stamped, material pushed out of each groove of the serration necessarily moves into the space between the grooves, increasing the actual maximum thickness of the sheet of material. Again, the combination of enhanced beauty and lower material cost is realized.

Although not intended to be limiting, variations of the present invention, shown and described herein, are distinguished by a changing or varying cross section for portions of the link elements while maintaining at least a portion of at least some of the link elements at a standard sized cross section. Thus, a distinct and decorative rope chain of a given length may have the identical effective rope chain diameter as one made with standard sized C-shaped link elements of constant cross sectional area, and yet result in substantial manufacturing cost savings due to less material being used in the manufacture of each individual link element, aside from the savings realized by forming the link elements using inexpensive stamping techniques.

It can therefore be appreciated that fabricating link elements having variably changing visual properties and/or variably changing cross sections, to provide uniquely shaped building blocks for producing exciting and beautiful visual effects in the construction of rope chains, may simultaneously have the synergistic effect of making such physically altered link elements, and thus the rope chains from which they are made, less expensive.

In accordance with one aspect of the invention, there is provided a gapped link element, and a method of manufacturing such a gapped link element, of the type that is assembled with other link elements to form a rope chain, each of the link elements being generally C-shaped in configuration to define a gap between facing ends thereof, each of the link elements having a first major surface, an opposite second major surface, an interior edge, and an exterior edge, the method comprising: providing a sheet of material having a plurality of regions, adjacent ones of which exhibit different visual properties; and stamping, with a stamping device, a link element from the sheet, the link element so produced comprising segments of at least two of the plurality of regions.

In another aspect of the invention, there is provided a jewelry rope chain link element of the type that is assembled with other link elements to form a rope chain, each of the link elements being generally C-shaped in configuration to define a gap between facing ends thereof, the link element comprising: a first major surface; an opposite second major surface; an interior edge; and an exterior edge; wherein the link element is manufactured by: providing a sheet of material; and stamping, with a stamping device, a link element from the sheet, the link element so produced departing from the shape and configuration of a standard link element by the provision of voids therein formed by the stamping device.

In yet another aspect of the invention, there is provided a jewelry rope chain link element of the type that is assembled with other link elements to form a rope chain, each of the link elements being generally C-shaped in configuration to define a gap between facing ends thereof, the link element comprising: a first major surface; an opposite second major surface; an interior edge; and an exterior edge; wherein the link element is manufactured by: providing a sheet of material; and stamping, with a stamping device, a link element from the sheet, the link element so produced departing from the annular shape and configuration of a standard link element.

In yet another aspect of the invention, there is provided a method of manufacturing a link element of the type that are assembled to form a rope chain, the method comprising: providing a sheet of material having a plurality of regions, adjacent ones of which exhibit different visual properties; stamping, with a stamping device, an elongated, substantially rectangular, strip of the material, the strip having a prescribed length, width, and thickness; and forming the strip into a rope chain link element having a generally C-shaped configuration, a first major surface, an opposite second major surface, an interior edge, and an exterior edge, the link element so produced comprising portions of the sheet of material that exhibit at least two of the visual properties.

In yet another aspect of the invention, there is provided A method of manufacturing a gapped link element of the type that is assembled with other link elements to form a rope chain, each of the link elements being generally C-shaped in configuration to define a gap between facing ends thereof, each of the link elements having a first major surface, an opposite second major surface, an interior edge, and an exterior edge, the method comprising: providing an elongated strip of bendable material having a left end, a right end, an elongated upper surface, an elongated lower surface, and elongated front surface, an elongated rear surface, and a surface ornamentation on at least one of the elongated surfaces; and bending the strip into a generally C-shaped configuration until the left and right ends face one another in a spaced relationship defining the gap between facing left and right ends. Optionally, the link element may have differently textured and/or colored upper and lower major surfaces.

Instead of, or in addition to, differently textured and/or colored major surfaces, the two major surfaces may exhibit differently textured or colored portions, e.g., one portion of a link element may be shiny and yellow gold in color, while another portion may have a sandblasted, frosted, patterned, matte, or simulated diamond cut finish appearance and white gold in color. Also, either major surface may be of a uniform shape and/or texture, while the other major surface is portioned as described.

A further variation has a portion of the link at a reduced annular width, which reduces material but nonetheless gives the appearance of a rope chain having an effective diameter the same as if the reduced portion was of normal annular width.

The interconnecting link elements may have differently colored, patterned, and/or textured portions, and may have different irregular or patterned shapes or shaped portions. For example, some or all of the link elements making up the rope chain may be partially or wholly smoothly circular with patterned major surfaces, circular with peripheral undulations, circular with peripheral gear-like teeth, circular with gouges or notches, may have constantly varying cross sectional portions, and/or may have an overall configuration that is star shaped, baguette shaped, square shaped, rectangular shaped, oval shaped, diamond shaped, D-shaped, heart shaped, etc. Similarly, different portions of each link element may have such different physical shapes.

A jewelry rope chain link element constructed in accordance with the invention preferably, but not necessarily, may have the shape and configuration of a standard annular link element with at least a portion removed and has a maximum link width equal to that of a similar standard annular link element without any portion removed.

Similarly, a length of rope chain employing link elements as described in the previous paragraph, has an effective maximum diameter equal to that of a similar length of rope chain constructed of solid, standard size annular link elements without any portion removed.

From the viewpoint of a finished length of rope chain, the invention provides a further improvement over the prior art, wherein: each link element in the length of rope chain may comprise a link portion exhibiting a first visual property, and another link portion exhibiting a second, different, visual property; whereby, when viewed from one side of the length of rope chain, the appearance of one of the helical rope strands is different than the appearance of the other, adjacent, helical rope strand along the length of rope chain.

For example, in one variation, the one helical rope strand is of a predetermined effective diameter, and the adjacent helical rope strand is of a different effective diameter than that of the one rope strand.

In another variation, the one helical rope strand has the shape of a helical cylindrical tube intertwined with the adjacent helical rope strand, and the adjacent helical rope strand has the shape of a helical cylindrical tube with an outer surface portion thereof cut away along the length of the helical cylindrical tube. The outer surface cutaway portion of the adjacent helical rope strand is formed during the stamping or die-cutting process.

When stamped from a sheet of material comprised of a number of edge-joined flat strips or regions, one helical rope strand may be a helical cylindrical tube displaying a particular color pattern and intertwined with the adjacent helical rope strand which may display the same or a different color pattern. For example, one helical rope strand may be of a solid color, while the adjacent helical rope strand may have an outer surface portion thereof of one color and an inner surface portion, adjacent a channel of the rope chain, of another color.

As a result of the various combinations possible in the manufacture of jewelry rope chains in accordance with the present invention, a virtually limitless number of different design possibilities exist, and preferred ones of such possibilities are shown and described herein. It is to be understood, however, that all combinations of: the number of interconnected link elements in the repeated pattern along the rope chain; solid or portioned coloration and/or texturing; different designs of the portioned regions of each major surface and/or side peripheral edges of the link elements; and different physical shape and/or visual properties as identified in this description may be employed in the manufacture of jewelry rope chains and are contemplated variations of the preferred embodiments specifically shown and described.

BRIEF DESCRIPTION OF THE DRAWING

Further objects and advantages and a better understanding of the present invention may be had by reference to the following detailed description taken in conjunction with the accompanying drawings in which certain figures are lined for color or texture, and in which:

FIG. 1 is a plan view of an annular link element which is the basic building element for the construction of jewelry rope chains as known in the prior art;

FIG. 2 is a front elevational view of the outward appearance of a jewelry rope chain of the prior art showing a uniform visual appearance for all link elements in the chain for the entire length thereof;

FIG. 3 is a plan view of a sheet of material showing multi-colored edge-joined flat strips or regions and, in dashed lines, the location and orientation of a link element to be stamped from such sheet of material;

FIG. 14 is a plan view of a sheet of material in which a preparatory step of imprinting surface texturing has taken place, prior to die-cutting out a link element from the material;

FIG. 15 is a cross sectional view of the sheet of material taken along the line 15—15 in FIG. 14, and showing two possible die-cut patterns for stamping out a link element;

FIG. 16 is a plan view of one configuration for a link element die-cut, or stamped, from the material shown in FIG. 14;

FIG. 17 is a plan view of another configuration for a link element die-cut, or stamped, from the material shown in FIG. 14, exhibiting a bulging effect to the segments of the link element that extend between the imprinted surface texturing;

FIG. 18 is a perspective view of a laminated sheet of material from which slices can be cut and eventually formed into a link element similar to that shown in FIG. 49 or 49A;

FIG. 69 is a fragment representation of the sheet of material shown in FIG. 66 or 67;

FIG. 70 is a is a front elevational view of the outward appearance of a length of jewelry rope chain showing the color or texture pattern resulting from assembling link elements including link elements stamped from the sheet of material shown in FIGS. 66 and 67;

FIG. 71 is a fragment representation of the sheet of material shown in FIG. 68;

FIG. 72 is a is a front elevational view of the outward appearance of a length of jewelry rope chain showing the color or texture pattern resulting from assembling link elements stamped from the sheet of material shown in FIG. 68;

FIG. 73 is a plan view of a sheet of material having multiple colored or textured regions, thereby exhibiting five different visual properties, and from which some of the link elements shown in FIG. 74 are stamped;

FIG. 74 is a is a front elevational view of the outward appearance of a length of jewelry rope chain showing the color or texture pattern resulting from assembling link elements stamped from a sheet of material or from different sheets of material, similar to that shown in FIG. 73, but with offset color/texture patterns on adjacent link elements;

FIG. 75 is a plan view of three different link elements, each stamped from a sheet of material or from different sheets of material, similar to that shown in FIG. 73, each link element exhibiting a different, i.e. offset, arrangement of color/texture patterns from the adjacent link element;

FIG. 76 is a plan view of a sheet of material from which curved slices can be cut and eventually formed into a link element; and FIG. 77 is a plan view of a sheet of material from which link elements can be stamped, the link elements being interlinked in layout and alternating in their gap positions to minimize material waste.

DEFINITIONS

Figure 4:
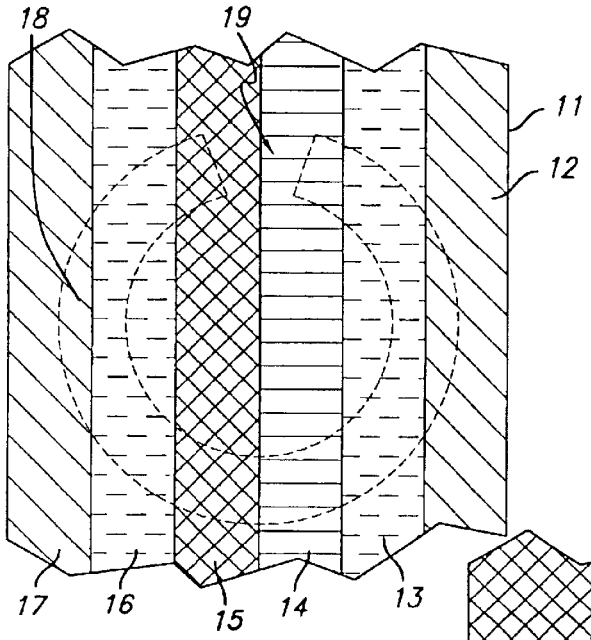
FIG. 4 is a view similar to that of FIG. 3, but with more colored adjoined strips and a different orientation of the link element to be stamped from such sheet of material.

For the purposes of this description, the following definitions are provided.

"Rope chain" is a series of sets of interlinked, or interconnected, link elements which has the appearance of a plurality of braided, or helically intertwined, multi-fiber strands of hemp, flax, or the like.

"Standard" or "Ordinary" refers to the dimensional characteristics of annular link elements without major surface or edge variation and whose dimensions follow the recommendations according to the aforementioned U.S. Pat. No. 4,651,517, for example, i.e. whose dimensions result in a tightly fitting series of link elements having the appearance of intertwining helical strands of rope.

A "set" is the number of adjacent interlinked, or interconnected, link elements making up a structurally repeated pattern along the chain. In the accompanying drawings and associated text, a six-link set is used for purposes of ease of visual presentation and description. The preferred number of link elements in a set is eight.

A "group" is a number of adjacent interlinked, or interconnected, link elements exhibiting identical visual properties. The number of link elements in a group may be the same or different than the number of link elements in a set. Groups may be uniformly or randomly distributed along the rope chain.

A "link" is the basic building element (also referred herein as a "link element"), a number of which are assembled in series to form a rope chain. Link elements of the prior art are annular in shape with an open gap having a length slightly greater than the width of the annular link. In accordance with the present invention, a link element may have a circular, baguette, oval, diamond, rectangular, square, polygonal, heart, or other geometrical shape. Each is provided with a gap at a selected position along the perimeter thereof thereby maintaining a generally C-shaped overall configuration. In such a generally C-shaped overall configuration, the inner periphery will be referred to herein as an interior edge, and the outer periphery will be referred to as an exterior edge.

While the link elements of a rope chain are not necessarily annular, it is the preferred configuration for the basic building element of a rope chain, and for that reason an annular link element will be used in most of the examples shown and described herein.

A "channel" is the path which the eye follows in passing along the rope chain at the apex of the V-shaped helical groove formed between the apparent intertwined rope braids. Hence, in the preferred embodiments described herein, the rope chain has the appearance of a pair of intertwined braids of ropes, and thus there exists two such helical channels offset from one another by one-half of the pitch of either helix.

A "visual property", as used herein, is a characteristic of an object which presents a particular visual image to the eye. Such characteristics include, but are not limited to, color, texture, pattern, reflectivity, design, or shape. Although shape is also a physical property of an object, in the art of jewelry making, it is often the physical shapes which impart beauty and delicateness to a fashion item.

"Color", as used herein, refers to the quality of the link element or portion thereof with respect to light reflected by it and visually perceived by the eye as a particular hue, saturation, and brightness of the reflected light. In most cases, the different colors exhibited by a link element or portion(s) thereof result from the use of different materials (white gold as differing from yellow gold as differing from rhodium as differing from enamel coatings of different hues, etc.

The "major surface" of a link element refers to the substantially flat or planar upper and lower facial surfaces of a link element. Such surface, although being substantially planar, nevertheless may have raised or depressed patterns therein, or may be notched, gouged, textured, or otherwise physically altered by the stamping process to present a desired pleasing visual effect to the observer. Additionally, the upper and lower facial surfaces need not be flat. For example, the link elements may be tubular, or otherwise circular in cross section, and yet have the uppermost and lowermost surface portions lying in respective parallel planes.

The "interior" and "exterior" edges of a link element are, respectively, the inner and outer peripheral sides which span between the upper and lower major surfaces of a link element. Such interior and exterior edges, may have raised or depressed patterns therein, or may be notched, gouged, textured, or otherwise physically altered by the stamping process to present a desired pleasing visual effect to the observer.

"Link width" is defined as a distance, measured along either of the major surfaces, between a pair of parallel lines perpendicular to the major surfaces and tangent to, respectively, the interior and exterior edges.

"Link thickness" is defined as a distance between and perpendicular to the planes of the upper and lower major surfaces.

"Configuration" refers to the overall appearance of a link element. Typical link elements are annular with a gap in the annulus to permit interlinking with other link elements. As disclosed herein, link elements can have shapes other than annular. However, all link elements have an overall C-shaped configuration.

"Die-cutting" as used herein refers to the process and tooling with which a die, constructed of hardened metal with sharp edges, is brought into contact with a sheet of material cutting portions out of the sheet of material according to a predetermined pattern of the sharp edges of the die.

"Stamping", can have the same meaning as "die-cutting" when meaning that a pattern is stamped (cut) out of a sheet of material. However, "stamping" is also defined as imprinting, striking, pounding, marking, or otherwise providing a distinctive character to a surface by the pressure of a die pattern against such surface. Thus, "stamping" can mean cutting of and/or impressing on a sheet of material. In particular, "pressure stamping" impresses a material under pressure, but does not cut through the material.

DETAILED DESCRIPTION OF THE PREFERRED EMBODIMENTS

With reference to FIGS. 1 and 2, conventional rope chains, such as that shown in FIG. 2, are made with a systematic and repetitive interlinking of basic annular link elements 1 such as that shown in FIG. 1. The annular link element 1 must meet certain dimensional requirements for the interlinking to result in a well-fitting rope chain. Such dimensions are known in the art and will vary from a four-link variety to a six-link variety to an eight-link variety, and so on. Determining the proper dimensions for the annular link element 1 and the gap 3 therein, depending upon the number of desired link elements to form a set of interlinked link elements, can be readily understood by reference to the aforementioned U.S. patents, especially U.S. Pat. No. 4,651,517. As can be viewed in FIG. 2 herein, the intertwined link elements 1 of a segment of a conventional rope chain are shown in FIG. 2 in the form of a six-link variety. In their assembled form, the series of link elements 1 produce the appearance of a pair of braids of rope, the combination of which results in a double intertwined helical appearance.

As seen in FIG. 2, the apparent intertwining of a pair of rope strands or braids results in a V-shaped groove between the braids at any position along the rope chain. The path along the apex of such V-shaped groove is referred to herein as a "channel", and since there are two apparent rope braids, there are, likewise, two defined channels indicating FIG. 2 by the directional arrows 8A and 8B. Channels 8A and 8B, along the length of the rope chain, define the transition points between the two helixes. However, the two channels never intersect one another, and are parallel to one another along the length of the rope chain separated axially by one half of the pitch of either of the two channels. In the prior art of FIG. 2, there is no visual difference between following along the two helical channels 8A and 8B, since the rope chain is comprised of a repetitive series of sets of link elements 1, and all link elements have the same visual property (they are all of the same color, texture, and shape for example).

Figure 65:
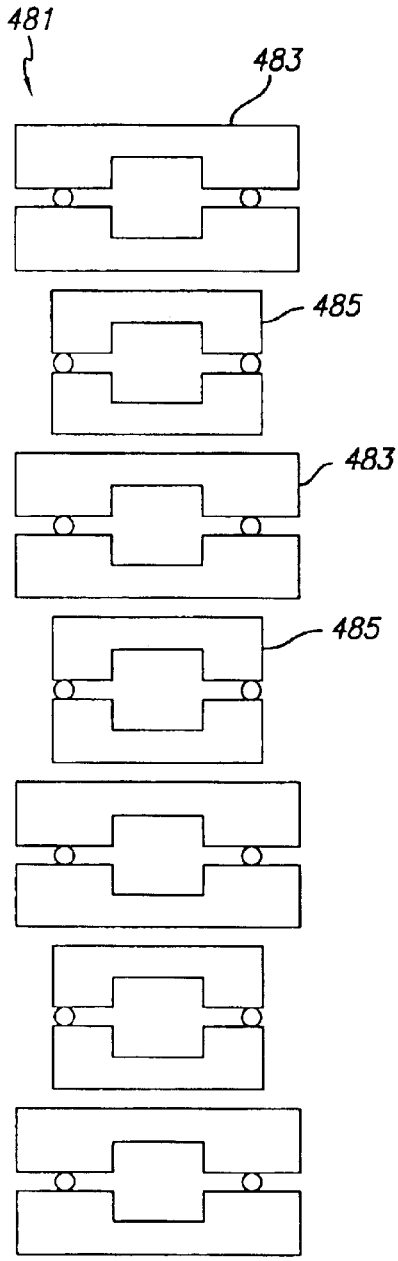
FIG. 65 is a schematic representation showing the assembly sequence of link elements forming a length of rope chain, employing pairs of link elements of standard, or substandard, annular widths alternating with pairs of link elements having relatively enlarged annular widths.

The remaining figures to be described, FIGS. 3–65, illustrate examples of a virtually limitless number of variations of the design and construction features of link elements that may be assembled into a distinctively beautiful and unique rope chain having appealing visual properties.

It will be appreciated that a link element may exhibit multiple colors due to a variety of possible physical constructions. For example, as in the aforementioned prior application Ser. No. 09/287,972, entitled "DECORATIVE JEWELRY ROPE CHAIN", a link element may be of laminated construction, such that one major surface is of one material or color and the opposite major surface is of a different material or color. Additionally, or alternatively, each or both major surfaces may be divided into portions, each portion exhibiting a color, texture, or shape different from its adjacent portion.

In describing FIGS. 3–65, it should be understood that the link elements so shown are all manufactured employing a stamping and/or die-cutting operation. In some embodiments, the link elements are stamped, or die-cut, in their final shape. In other embodiments, texturing is pre-applied prior to stamping or die-cutting. In yet other embodiments, the link elements are formed by bending strips of material which themselves were stamped, or die-cut, from a sheet of material.

In FIG. 3, the plan view of a sheet of material 4 has regions 5 and 6 exhibiting different visual properties, represented in FIG. 3 as different colors. When stamped from the sheet of material 4, the annular link element 7, the position and orientation of which is shown in dashed lines, will have; on at least one planar major facial surface thereof, a first segment 5A of a first visual property, e.g. color, and a second segment 6A of a second visual property, e.g. color. The link element 7 may be formed, for example, by stamping a flat sheet constructed of two edge-joined strips of different flat materials, or of two edge-joined strips of materials of different colors and/or textures and/or coatings (such as by the application of an enamel).

It will be noted in FIG. 3 that the link element 7 to be stamped from the sheet of material 4 has its gap 9 oriented at approximately a two o'clock position, such that a short portion on the left side, or arm, of the link element 7 near the gap 9 will be of white gold color, while the remainder of the left side will be of a yellow gold color. The opposite is true of the right side, or arm, of link element 7, i.e. a large segment of the right side adjacent the gap 9 is of a white gold color, while a shorter segment of the right side is of a yellow gold color. When a number of such link elements 7 are assembled into a rope chain, an interesting color pattern will be observed in the double helical length of rope chain. That is, one of the helixes will have a predominant white color with a small portion of the helix being of a yellow color adjacent one of the rope chain channels, while the other helix will be primarily of a yellow color with a small portion of the helix being of a white color adjacent one of the rope chain channels.

In this connection, most of the remaining figures are not lined for color. However, it will be understood that all, or portions, of each of the link elements to be described hereinafter may be of a color selected from a variety of different colors, and/or may be made of a material selected from a variety of different materials. For example, any of the link elements described herein may have the entire surface, or portions thereof, of yellow gold, white gold, rose (pink) gold, green gold, silver, nickel, or rhodium, either solid, plated, or laminated; or such surfaces, or portions thereof, may be enameled.

In some cases, the gapped link elements may be stamped from a multicolored flat-sheet comprising a number of edge-joined strips of alternately colored gold materials, or alternately of different materials such as gold and silver. Such a multicolored flat sheet may be stamped to form gapped link elements in different orientations relative to the strip pattern and relative to the gap position, resulting in a variety of interesting colored patterns in the finished rope chain, yet all such link elements can be stamped from the same multicolored stripped sheet.

FIG. 4 is a view similar to that of FIG. 3, except that the sheet of material 11 comprises a larger number of colored strips 12–17, and the link element 18 to be stamped from the sheet of material 11 has a different orientation relative to the longitudinal extent of the edge-joined strips 12–17. With the gap 19 oriented at the twelve o'clock position, a length of rope chain constructed by assembling a number of link elements 18 will produce a length of rope chain of two intertwined helixes, but with the outermost surface of each helix being of the same color, since strips 12 and 17 are lined for the same color of material. On either side of the outermost peripheral surface of each helix, a short length of a different color will be observed from one helix to the other, since strips 13 and 16 are lined to indicate two different colors, although they could be the same if desired. Then, the extreme visible inner portion of each helix, along the rope chain channels, will have yet a third and fourth color visible to the observer, due to the different colored strips 14 and 15 lined in FIG. 4 to indicate different coloration between the two strips.

In the remaining figures to be described, the relative position of the gap in the link chain to be produced and the number of strips, width of each strip, and color of each strip will obviously produce different visual effects, and the description of FIGS. 3 and 4 above will serve as a basis for understanding the resulting color/texture/shape or pattern that will be visible in the intertwining helixes. Moreover, by reference to the aforementioned patent application Ser. No. 09/337,455 entitled "Jewelry Rope Chain Link Element", U.S. Pat. No. 4,651,517, and U.S. Pat. No. 5,301,498, an appreciation of the display of visual properties of a length of rope chain will be fully understood by a person of ordinary skill in the art of making rope chains. Accordingly, minute details of the visual effects resulting from manufacturing and assembling the link elements yet to be described, and resulting from assembling combinations of link elements described in this specification, are unnecessary.

Figure 5:
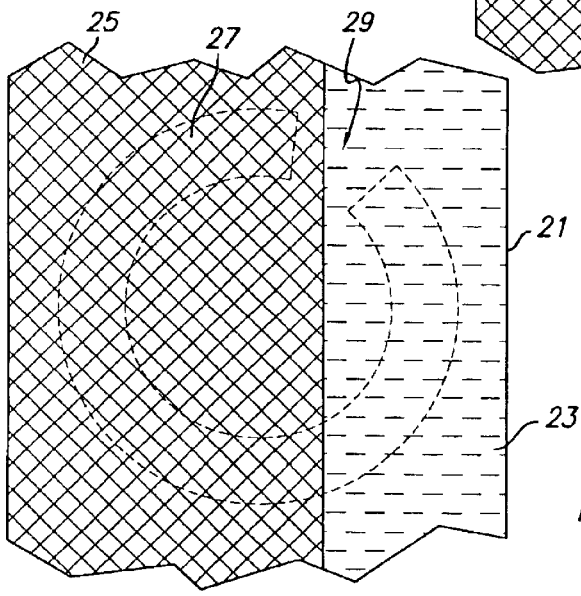
FIG. 5 is a view similar to that of FIG. 3, but with different widths of the colored strips making up the sheet of material.
Figure 7:
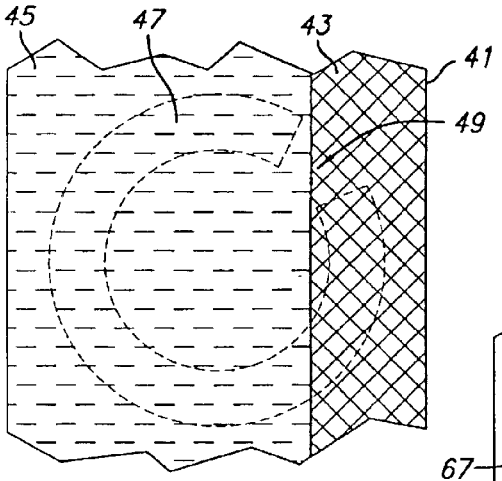
FIG. 7 is a view similar to that of FIG. 5, but with different widths of the colored strips making up the sheet of material and a reversal of the colored strips.

FIGS. 5 and 7 illustrate how the visual properties of the link elements 27 and 47, respectively can be varied by varying the widths and arrangement of the visual properties of the sheet of material 21,41.

FIG. 5 is a view similar to that of FIG. 3, except that the sheet of material 21 is comprised of two edge-joined strips 23, 25 which are not only of different colors but are of different widths. With the gap 29 oriented at about a one o'clock position, one of the helixes of the finished rope chain will be of an all yellow gold color, while the other helix will be both yellow and white gold in color.

Figure 6:
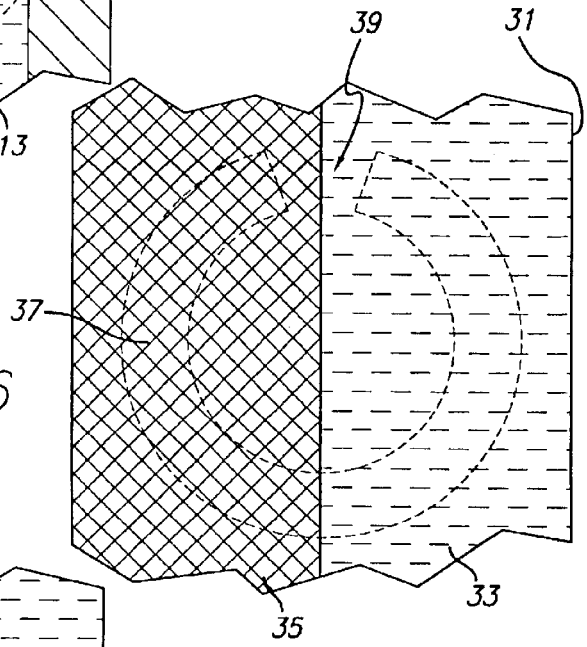
FIG. 6 is a view similar to that of FIG. 3, but showing a different orientation of the link element to be stamped from such sheet of material.

FIG. 6 is also a view similar to that of FIG. 3, but showing a different orientation of the link element 37 to be stamped from the sheet of material 31 comprised of edge-joined colored strips 33 and 35. With the gap 39 oriented at the twelve o'clock position, the two helixes will both be of a single color, but one helix will be of white gold and the other will be of yellow gold in color. The lined colors shown in FIG. 6, and in all of the accompanying figures, are intended to be representative of any two, or multiple, colors, and thus the two strips 33 and 35 in FIG. 6 may be both of yellow gold, but with one strip being of a relatively low gold karat weight and the other of a relatively higher gold karat weight.

FIG. 7 is a view similar to that of FIG. 5, but with the sheet of material 41 comprised of two differently colored edge-joined strips 43 and 45 having different widths than those shown in FIG. 5 and a color reversal of the stripped regions 43 and 45. The gap 49, however, is oriented similar to that shown in FIG. 5.

Figure 7A:
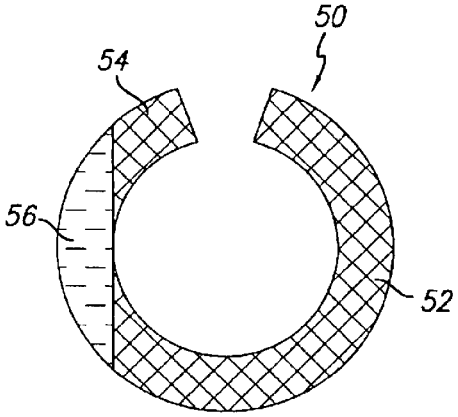
FIG. 7A is an example of a link element stamped from a multicolored sheet of material.

FIG. 7A is an example of a link element 50 stamped from a multicolored sheet (not shown) of material, resulting in a major yellow gold portion 52, a minor gold portion 54, and a central segment 56 of white gold on one of the halves of the link element 50. A rope chain constructed from link elements 50, if central segments 56 are all aligned link-to-link, would have the appearance of a primarily yellow gold rope chain with the outermost peripheral edge of one of the helical rope strands displaying a central helical path of white gold.

Figure 8:
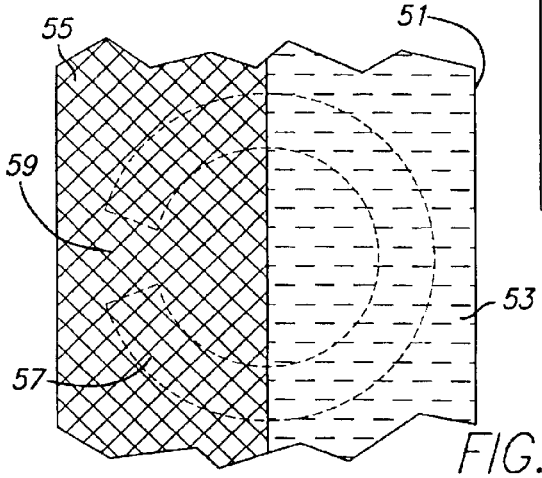
FIG. 8 is a view similar to that of FIG. 3 or 6, but showing a different orientation of the link element to be stamped from such sheet of material.

FIG. 8 is a view similar to that of FIG. 3 or 6, but showing a different orientation of the gap 59 for the link element 57 to be stamped from the sheet of material 51 comprising colored elongated regions 53 and 55. A length of rope chain constructed of link elements 57, alternating with link elements of similar construction but with the colors in regions 53 and 55 reversed, would thus display one-half of each of the two helixes as white gold and the other half as yellow gold, with one side of each channel (8A and 8B, FIG. 2) of white gold, and the other side of yellow gold.

FIGS. 6 and 8 show how the visual properties of the link elements 37, 57 can be varied by stamping, from sheets with substantially the same visual properties, link elements with their respective gaps 39, 59 in different angular orientations. For example, in FIG. 6, the stamping produces a link element 37 with a gap 39 oriented such that the link element is bifurcated in half through the gap 39, and each half of the link element 37 is of a different visual property. By simply setting the stamping of the link element to be in a different angular position (as in FIG. 8), where the gap 59 is rotated 90 degrees, the orientation of the visual properties on the link element 57 is also offset by 90 degrees. This has significance, because certain parts of a link element relative to its gap have more visibility in the finished rope chain than other parts. The foregoing is just one example of how the position of visual properties on the individual link elements may be changed by varying the angular position of stamping without changing the arrangement of visual properties of the sheet on which the stamping is applied.

By the combination of varying: 1) the visual properties of a sheet on which stamping is applied; and 2) the angular position of stamping, a myriad of link elements with different visual properties may be produced that will, in turn, result in a great number of rope chains of varying visual properties.

Figure 9:
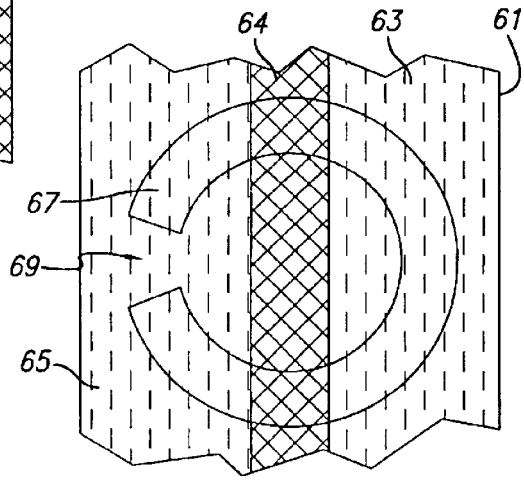
FIG. 9 is a view similar to that of FIG. 8, but with a different number and arrangement of colored strips making up the sheet of material.

In FIG. 9, the sheet of material 51 has wide white gold edge-joined strips 63 and 65 with a central yellow gold strip 64 of smaller width. With the gap 69 in the nine o'clock position, as shown, a link element 67 stamped from the sheet of material 51 would display both helixes as white gold in color with a yellow gold helical band directly in the center of each helix.

Figure 10:
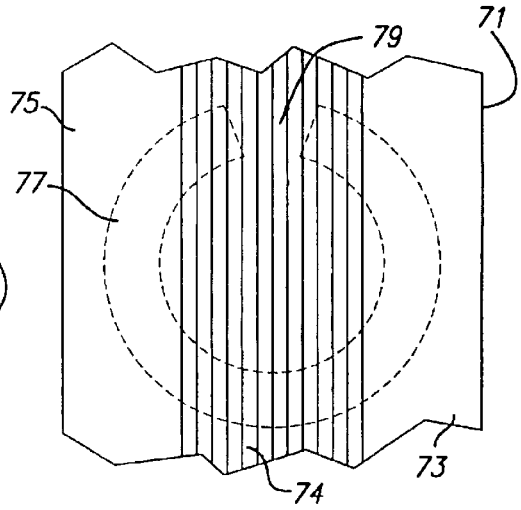
FIG. 10 is a plan view of a sheet of material having an intermediate textured region and, in dashed lines, the location and orientation of a link element to be stamped from such sheet of material.

FIG. 10 illustrates that, instead of, or in addition to, color elongated edge-joined strips, a sheet of material 71 may have a preformed length of textured surface 74 leaving the surface areas 73 and 75 on each side of the textured surface 74 non-textured. With the gap 79 at the twelve o'clock position, as shown, a link element 77 will present a non-textured outer surface of each of the two helixes, while the inner sides of the helixes, i.e. on a major facial surface along the channels of the rope chain (see reference numerals 8A and 8B in FIG. 2) will be textured.

In FIG. 10 and other figures showing preformed regions of textured surfaces, parallel lines are typically depicted, suggesting a scored or serrated textured appearance. It is to be understood that this showing of pre-textured surfaces are examples only, and that any other known pre-texturing process can be used. Other examples include forming at least one of the regions of different surface textures employing at least one process selected from the group consisting of serrating, scoring, knurling, lining, patterning, pressure stamping, impressing, sandblasting, etching, shaping, polishing, matting, frosting, and diamond cutting.

Figure 11:
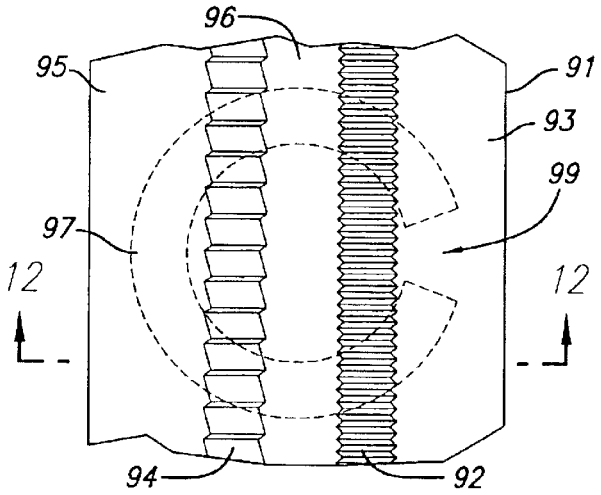
FIG. 11 is a plan view of a sheet of material having multiple textured regions, thereby exhibiting three different visual properties, and, in dashed lines, the location and orientation of a link element to be stamped from such sheet of material.

FIG. 11 illustrates the possibility of providing a sheet of material 91 with two different regions of surface texturing shown at 92 and 94 in FIG. 11, leaving the regions 93, 95, and 96 non-textured. With the gap 99 at the three o'clock position, as shown, each of the two helixes of an assembled rope chain will show a pair of spaced textured helical stripes equally spaced from the outermost surface of the helixes.

Figure 12:
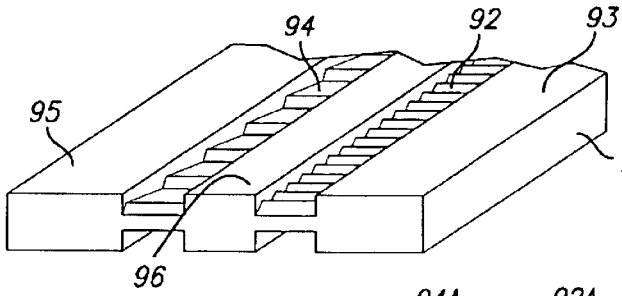
FIGS. 12 and 12A are perspective views of the segment of sheet material shown in FIG. 11 taken along the line 12—12 in FIG. 11, for the respective embodiments in which textured regions are present in the top only, or in both the top and bottom major surfaces of the sheet of material.
Figure 12A:
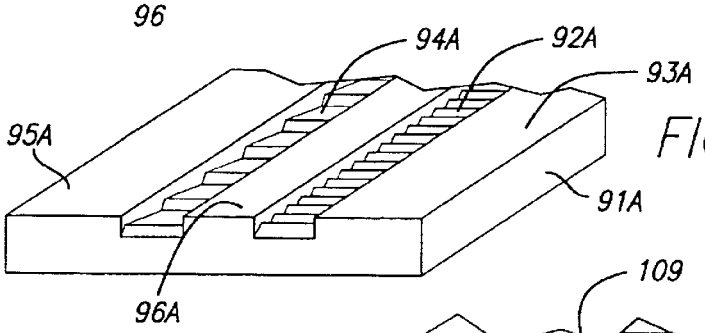

FIGS. 12 and 12A illustrates one possible physical structure for the double textured sheet of material 91 shown in FIG. 11. In FIG. 12, it will be observed that the two textured surfaces 92 and 94 on the upper side of the sheet of material 91 have different geometrical properties, and that similar textured regions (not numbered) can optionally be formed on the lower surface of the sheet of material 91 and may have the same or different textured patterns.

Figure 13:
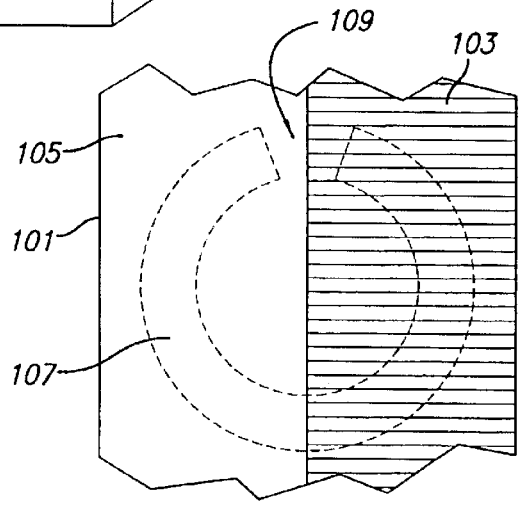
FIG. 13 is a view similar to that of FIG. 10, but with the position of the textured region in a different location and having lines representing the texturing perpendicular to the length of the sheet of material.

In FIG. 13, the sheet of material 101 has two differently textured regions 103 and 105, the region 103 being a textured surface, and the region 105 being either textured differently or non-textured. With the gap 109 at the twelve o'clock position, as shown, a length of rope chain constructed of link elements 107 would display one helix with a textured major surface and the other with no texturing or a different textured major surface.

FIG. 14 is a plan view of a sheet of material 111 in which a link element 115 or 117 can be die-cut from the sheet of material 111 and display radially directed texture patterns 113A–113D as shown. FIG. 14 also shows that the pattern of the cutting edges in the die-cutting process can produce an annular shaped link element 115 or a link element 117 having features departing from the standard annular configuration. In a preferred embodiment of the invention, either link element 115 or 117 may be die-cut simultaneously with the stamping of the upper planar surface of the sheet of material 111 forming the radially directed impressed lined patterns 113A–113D. Alternatively, a lined pattern such as that shown in dashed lines as numeral 114 may be formed on the sheet of material in a preparatory step of imprinting the surface texturing at specific locations, after which the die-cutting process will cut the link element 115 or 117 from the sheet 111. The textured pattern 114 intentionally extends a length greater than the annular radius of the link elements 115, 117 to allow for tolerance in the registration of the pressure stamping process which impresses the texture pattern and the die-cutting process which severs the link element 115, 117 from the sheet of material 111.

Although FIG. 14 shows a particular pattern for a number of radially directed stamped, or impressed, lines, the illustration in FIG. 14 is exemplary only, and any pattern of surface texturing can be applied along a portion or the entire extent of the link element 115, 117 to be die-cut from the sheet 111, depending upon the choice of the designer.

FIG. 15 is a cross sectional view of the sheet of material 111 taken along the lines 15—15 in FIG. 14. This figure shows the character of the impressed textured areas 113A–113D relative to the thickness of the sheet of material of 111.

FIG. 16 illustrates the plan view of a link element 115 die-cut from a sheet 111 shown in FIG. 14 for an annular configuration of the link element.

FIG. 17 illustrates the plan view of a link element 117 die-cut from a sheet 111 shown in FIG. 14 for an alternate configuration of the link element, with bulging portions 119 of the link element 117 extending between the imprinted surface textured areas 113A–113D, for decorative purposes.

FIG. 18 is a perspective view of a laminated sheet of material 151 comprised of, for example, a layer of white gold 156 and a layer of yellow gold 158 (or both layers 156, 158 can be of yellow gold of different gold karat weights). In a stamping, or die-cutting, process, slices 150 can be cut from the sheet of layered material 151 and eventually formed into a link element by a bending or rolling process to be described hereinafter with reference to the forming method depicted in the action perspective view of FIG. 30, and with reference to the layered link element shown in FIGS. 49 and 49A. A length of rope chain constructed from a group of assembled link elements as shown in FIG. 49, would thus have the general appearance of a rope chain having essentially the color of the outer layer on the link element so formed.

Figure 49:
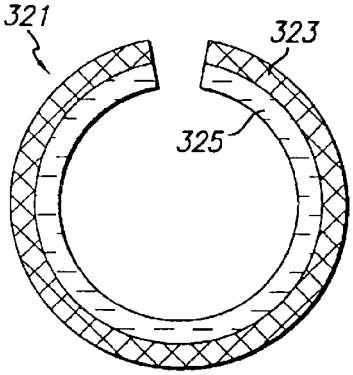
FIG. 49 is a plan view of a link element formed by bending a layered wire or a slice of a sheet of layered material such that the major surfaces exhibit multiple colors or textures, and the inner and outer edges exhibit a single color or texture.
Figure 49A:
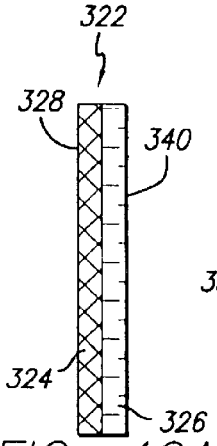
FIG. 49A is an edge side view of a link element formed by bending a layered wire or a slice of a sheet of layered material such that each major surface exhibits a single color or texture, and the inner and outer edges exhibit multiple colors or textures.

While FIGS. 18, 49, and 49A depict one color representing yellow gold and the other color representing white gold or silver, it may be desirable to laminate together two yellow gold layers of different gold karat weight. If the two layers 156, 158 are both yellow gold of different karat weights, 7K and 14K for example, and the link element is formed with a 14K outer layer, the visual impression of a finished rope chain will be essentially that of a 14K gold rope chain, giving a purchaser the desired visual quality at lower cost.

In this connection, FIGS. 18–31 are all concerned with the forming or-shaping of a strip of material into the configuration of a link element after the strip has been sliced, e.g. die-cut, from a sheet of material. FIG. 18, as noted above, may be sliced and bent into annular shape to produce the layered link element shown in FIG. 49. In FIG. 49, the major surfaces exhibit multiple colors or textures 323, 325, and the inner and outer edges each exhibit a single color or texture 323, 325, while in FIG. 49A each major surface 328, 340 exhibits a single color or texture, and the inner and outer edges (inner edge not visible in FIG. 49A) exhibit multiple colors or textures.

It should be noted that, depending upon the choice of material thicknesses and width of the slices 150 and 150A, the slices 150 and 150A can be bent in any of four different directions to produce a major surface with either material 152A or 154A and the other major surface with the other material (or both yellow of different gold karat weights, cf. FIG. 6 of the aforementioned U.S. application Ser. No. 09/287,972), or to produce a major surface having the interior edge of one material 152 and the exterior edge of the other material 154, or vice versa (cf. FIG. 49). FIG. 18 is illustrative of two thicknesses of laminated materials 156 and 158 on either side of a transition region 151A permitting construction of link elements of the types just described.

Figures 19, 20, 21, 22, 23, 24, 25, 26, 27:
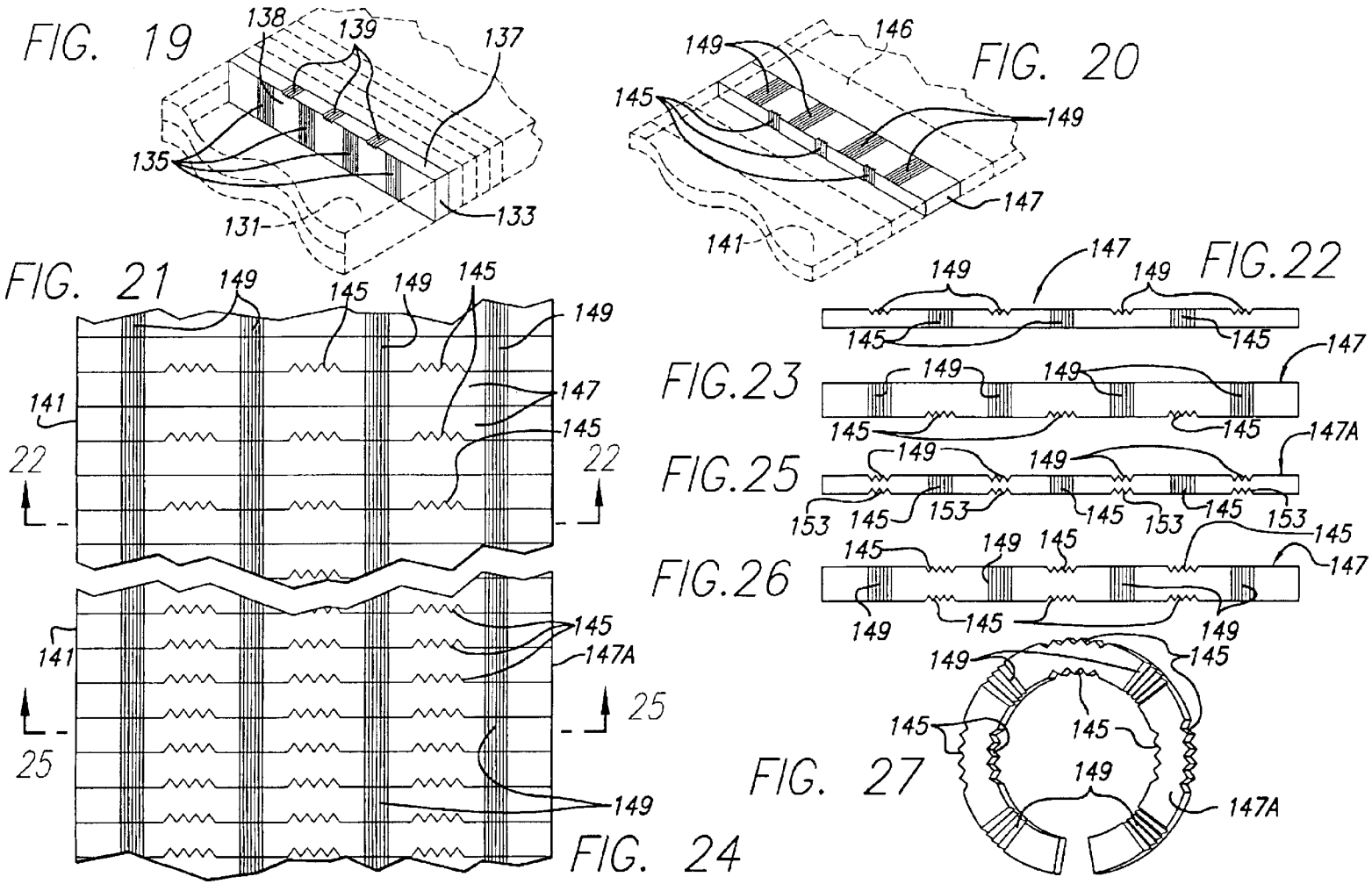
FIG. 19 is a perspective view of a slice from a relatively thick sheet of material that can be bent, or rolled, to form a link element which has texturing on its major and/or edge surfaces.
FIG. 20 is a perspective view of a slice from a relatively thin sheet of material that can be bent, or rolled, to form a link element which has texturing on its major and/or edge surfaces.
FIG. 21 is a plan view of a length of sheet material from which slices can be taken and formed into a link element having surface texturing on one major surface and one peripheral edge thereof.
FIG. 22 is a side elevational view of the slice of material shown in FIG. 20 and taken along the line 22—22 in FIG. 21.
FIG. 23 is a top plan view of the slice of material shown in FIG. 22.
FIG. 24 is a plan view of a length of sheet material from which slices can be taken and formed into a link element with surface texturing on both major surfaces and both interior and exterior edge surfaces thereof.
FIG. 25 is a side elevational view of a slice of material similar to that shown in FIG. 20, but taken along the line 25—25 in FIG. 24.
FIG. 26 is a top plan view of a link element shown in FIG. 25.
FIG. 27 is a perspective view of a link element formed from the slice of material shown in FIGS. 25 and 26.

FIGS. 19–31 are specifically directed to the formation of textured surfaces on the major surfaces of the ultimate link element and/or on the peripheral edges of the ultimate link element. Both major surface texturing and edge surface texturing will be dealt with in the ensuing paragraphs. FIG. 19, like FIG. 18, shows a sheet of material 131 from which strips 133 may be sliced, the strips 133 having the precise dimensions of width, thickness, and length so as to meet the specifications and requirements for interlinking link elements formed therefrom with other similar link elements to form a rope chain. In FIG. 19, the sheet of material 131 is not shown to be layered, but it may be layered, if desired. However, whether layered or not, the strips 133 are stamped and/or die-cut from the sheet of material 131 with the die-cutting device having spaced apart zig-zag cutting edge portions to form the vertical textured surfaces 135 shown in FIG. 19. Additionally, as the die-cutting tool (not shown) slices through the sheet of material 131, the tooling simultaneously impresses a secondary series of textured surfaces 139 on the top surface of the sheet of material 131. If the strip 133 shown in FIG. 19 has its ends bent downwardly about a mandrel, a link element similar to that shown in FIG. 27, except for the textured interior edge, would result. Specifically, the link element shown in FIG. 27 results from a slightly different process as will now be described.

From the description of FIG. 19, it will be appreciated that the sheet of material 131 has a thickness greater than the width of the slice 133, so that the link element formed by bringing the ends of the strip 133 downwardly around a mandrel will produce a link element of the proper physical dimensions for the construction of a rope chain.

An alternate, and preferred, method is to provide a thinner sheet of material 141 such as that shown in FIG. 20 and die-cutting strips 147 of wider dimension, as shown. This method has two advantages. First, it is easier to die-cut a strip from a thin material than it is from a thicker material. Secondly, since a link element formed by bending the strip 147 requires the ends of the strip 147 as shown in FIG. 20 to be bent toward the observer about a mandrel, this permits the stamping/die-cutting procedure to form zig-zag edge patterns 145 on both the front and rear edges of the strip 147. This process will be described in connection with FIGS. 24–27.

FIG. 21 is a top plan view of the sheet of material 141 showing four groups of lined patterns 149 representing any desired texturing design formed on a sheet of material 141 prior to the slicing of the sheet of material 141 into strips to be formed into link elements. The die-cutting tool, in order to produce the strip 147 necessarily has three spaced zig-zag patterns on its front edge to form the zig-zag textured surface 145 on the strip 147 so produced. With every other slice line formed by the die-cutting tool being non zigzagged, the textured pattern 145 is formed on only one peripheral edge of two adjacent strips 147 simultaneously.

FIG. 22 is a side elevational view of the slice of material 147 shown in FIGS. 20 and 21, better illustrating the positioning of the major surface texturing 149 and the peripheral edge texturing 145 prior to the strip 147 being formed into a link element.

FIG. 23 is a top plan view of the slice of material 147 shown in FIG. 22.

FIG. 24 is a view similar to that of FIG. 21 except that both peripheral edges of all strips 147A have the peripheral edge texturing pattern 145. Moreover, it is to be understood that the bottom surface of the sheet of material 141 in FIG. 24 has the identical texturing pattern 149 as shown on the top surface of the sheet. Accordingly, FIG. 25 shows surface texturing 149 on the top major surface of the strip 147A, while the numeral 153 represents the spaced texturing design patterns on the bottom surface of the strip 147A.

As best seen in FIG. 26, as described in connection with FIG. 24, the zig-zag textured portions 145 on the peripheral edges of the strip 147A are on both peripheral edges.

FIG. 27 thus is a perspective view of a link element formed from the slice of material 147A shown in FIGS. 25 and 26.

Figure 28:
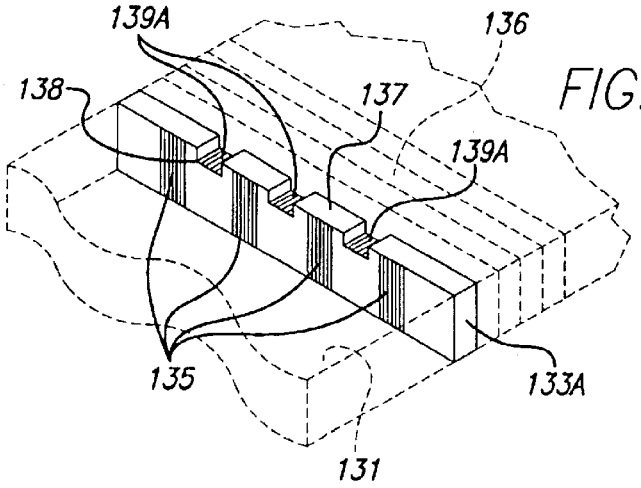
FIG. 28 is a perspective view similar to that of FIG. 19, but with deep cut and textured, elongated, and linear recesses formed in the sheet of material from which a slice is to be taken.

FIG. 28 is a perspective view similar to that shown in FIG. 19, but with deep cut notches forming textured recesses 139A formed in the sheet of material prior to slicing the sheet 131 to form strips 133A.

Figure 29:
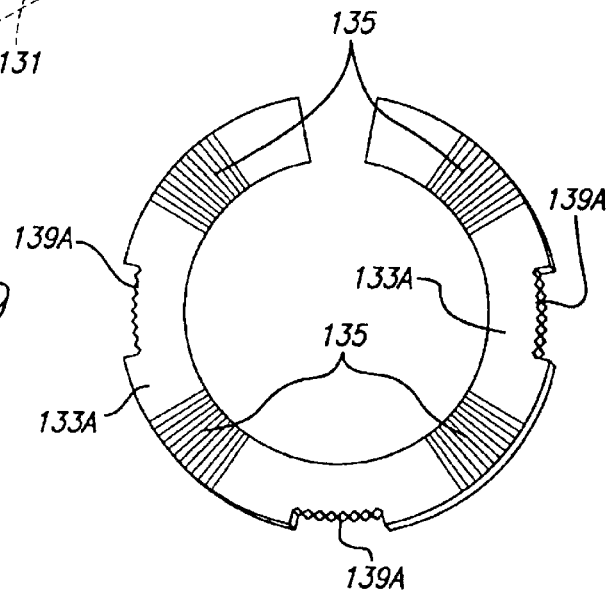
FIG. 29 is a perspective view of a link element made from the slice of material shown in FIG. 28.

Employing the process of forming a strip 133A suggested by FIG. 28, a link element having the characteristics shown in FIG. 29 results.

It will be understood that, for ease of drawing and description, the textured patterns shown in FIGS. 10–17 and 19–29 are shown as a group of parallel lines for ease of presentation only. The stamping and/or die-cutting tool may just as easily be manufactured to have any desired surface texturing or pattern at the whim of the designer. Each of the areas shown to be lined patterns may simply be regions of simulated sand blasting, matting, serration, knurling, or may be some design having geometrical figures as its content, or other design patterns, such as happy faces, heart shapes, flower petals, leaf patterns, and the like.

Figure 30:
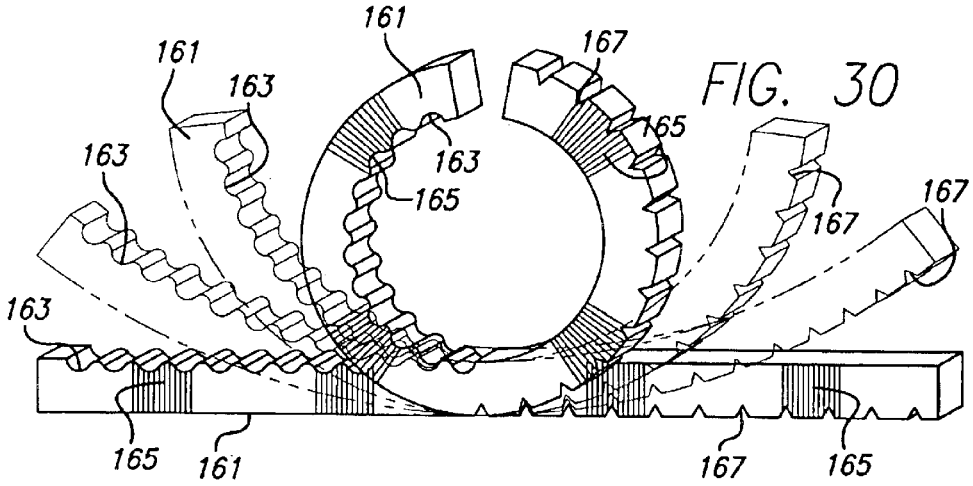
FIG. 30 is an action perspective view showing four time positions of a slice of material, or a wire, illustrating the bending positions of a straight textured and shaped slice or wire into the configuration of a link element.

Stamping is merely one method of fabricating annular link elements for the manufacture of rope chains. Link elements can also be made from wire. As in the case of "stamping", different visual properties can first be made on the wire prior to the making of the link element. FIG. 30 shows a portion of a wire 161 that can be made into an annular link element for the purpose of making rope chains with a distinctive and decorative design. The removal or omission of material from the wire, as shown, has an additional benefit of savings of precious metal resulting in lowered cost of materials.

FIG. 30 is an action perspective view showing four time positions of a slice of material 161 or a prepared strip or wire, illustrating the bending of a straight textured and shaped slice or wire into the configuration of a link element.

As can be seen in FIG. 30, a rather scalloped design of impressions 163 may be formed on any portion of a strip of material 161 which, after forming of the link element, produces a notched interior edge 163. Similarly, the right bottom side of the strip 161 may have V-grooves 167 formed therein so that the formed link will have the V-grooves 167 on its outer peripheral edge. Using any of the process steps mentioned above, the sides of the strip 161 may be provided with a pattern of textured regions 165 which then show as textured regions on the major surface or surfaces of the ultimately produced link element.

Although it has been adequately described earlier in this specification, the notches 163, V-grooves 167, and side serrations or textured patterns 165 of the link element shown in FIG. 30 all contribute to removing precious metal from the otherwise solid annular ring-shaped link element. As a result, not only is precious metal conserved without diminishing the structural integrity of the link element, but interesting patterns of the rope chain from which the link elements are made can be produced as described herein. The link element produced by the process described in connection with FIGS. 28 and 29, for example, result in a significant savings in precious metal content.

Figure 31:
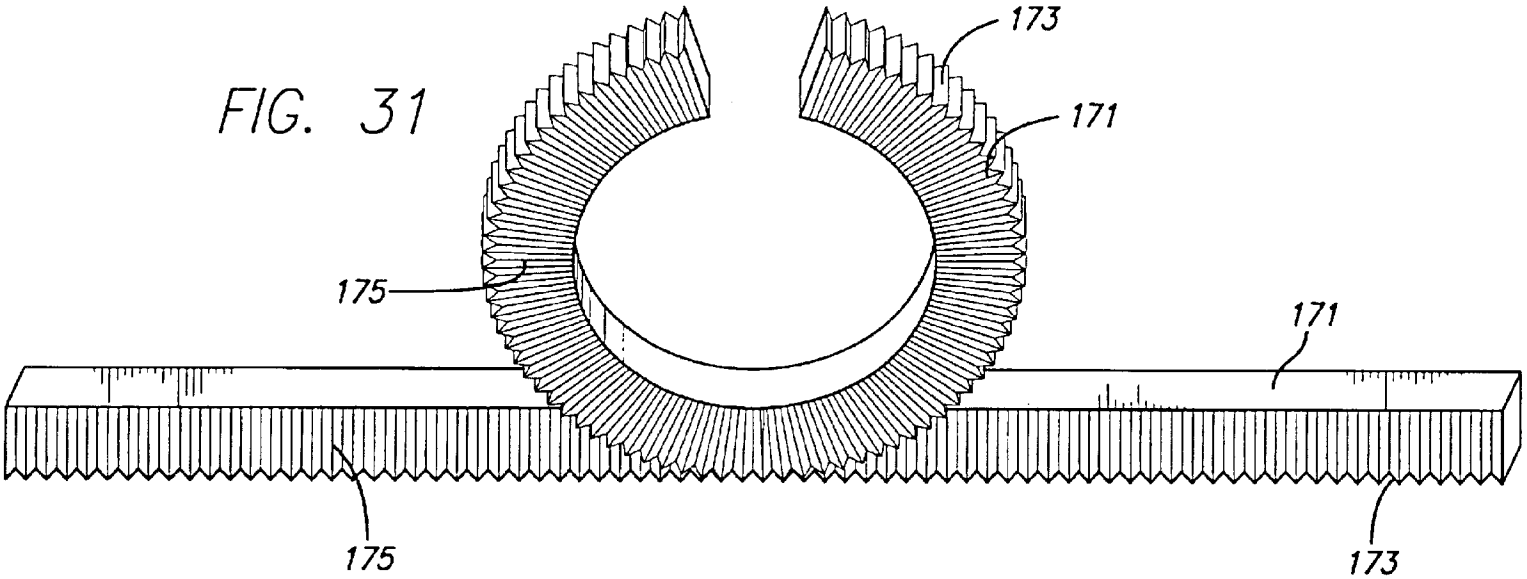
FIG. 31 is a view similar to that shown in FIG. 36, but without showing intermediated bending positions, and with a different pattern of surface texturing.

FIG. 31 is a view similar to that shown in FIG. 30, but without showing intermediate bending positions, and with a different pattern of surface texturing, i.e. serrations 175 formed on the major surface of the wire or strip of material/link element 171, and additional serrations 173 formed on the exterior peripheral edge. FIG. 31 thus shows the manufacture on an annular link 171 exhibiting serration-like characteristics from a wire or strip 171 first formed with such serration-like characteristics.

Figure 32:
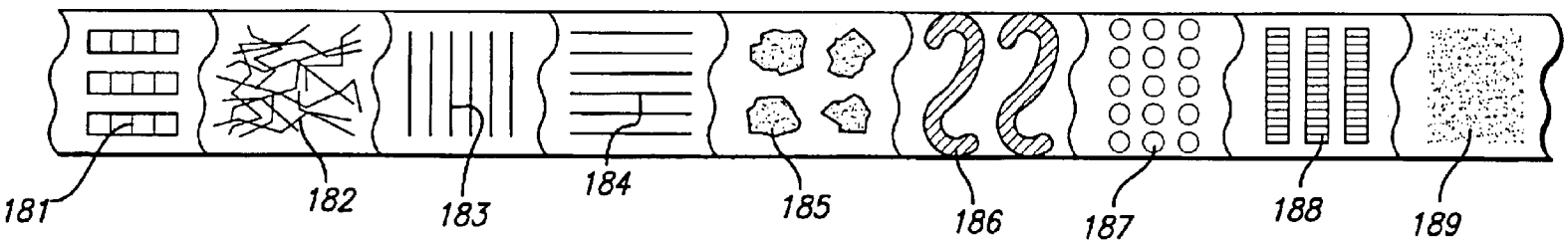
FIG. 32 shows examples of different surface texturing that may be selected to cover portions or the entire major or edge surfaces of a link element made in accordance with the present invention.

FIGS. 30 and 31 are exemplary only. The wire or strip may be formed with a variety of different visual properties as illustrated in FIG. 32 which schematically shows examples of different surface texturing 181–189 that may be selected to cover portions or the entire major or edge surfaces of a link element made in accordance with the present invention. FIG. 32 illustrates that the surface texturing may include parallel serrated strips 181, random raised lineation 182, cross-serrations 183, lineal serrations 184, raised portions 185, filigreed elements 186, either raised beads or depressed beads 187, parallel serrated strips 188 in a direction different that of 181, and sandblasted texturing 189. Again, these are provide for the purpose of illustration only, as there are an endless number of visual properties that can be imparted to the wire or strip prior to fabricating the link element.

FIGS. 33–59 illustrate examples of link elements that can be formed to exhibit different visual properties. Some of these are for decorative purposes only while others provide for savings in the amount of materials used to make rope chains. Some provide both benefits.

Figure 33:
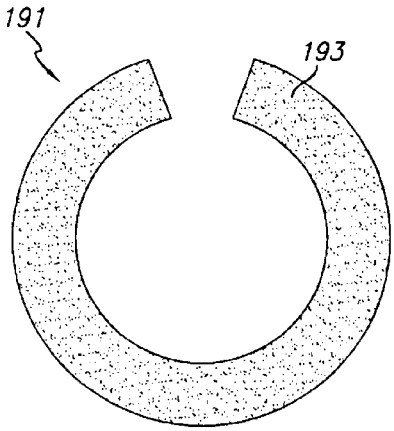
FIG. 33 is a plan view of a link element of standard annular configuration and displaying examples of major surface texturing.

FIG. 33 shows an annular link element 191 having the entirety of one of its major surfaces 193 textured, simulating a sandblasted surface. This is made possible by fabricating the stamper tooling device with a sandblasted inner surface. When the link element is die cut from a sheet of material, the pressure of the stamper simultaneously creates the simulated sandblasted effect on the major surface which the stamper contacts.

Figure 34:
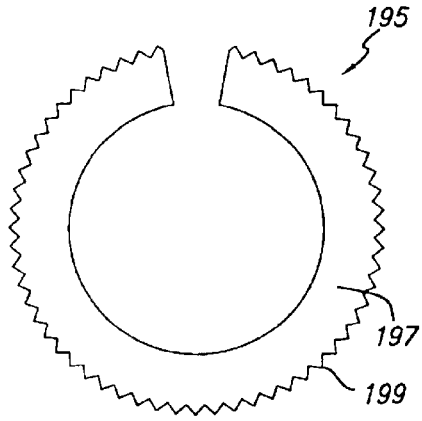
FIG. 34 is a plan view of a link element in which the exterior edge is serrated.

FIG. 34 shows an annular link element 195 having a smooth major surface 197, and with the exterior edge 199 serrated. This is made possible by providing the stamper tooling device with a serrated cutting edge.

Figure 35:
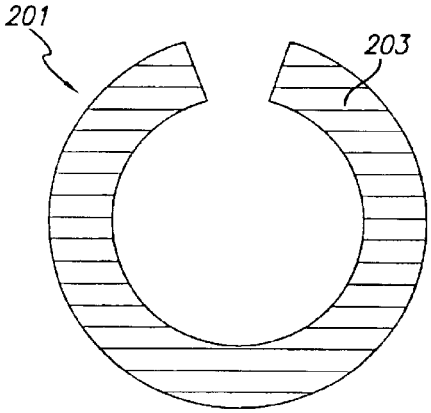
FIGS. 35–39 are plan views of link elements each of a standard annular size and configuration and displaying different preferred color and/or texture patterns on a major surface thereof.

FIG. 35 shows an annular link element 201 having the entirety of one of its major surfaces 203 serrated. This is made possible by fabricating the stamper tooling device with a serrated inner surface, or, preferably, creating serrations along the entire length and width of the sheet of material from which the link element 201 will be cut.

Figure 36:
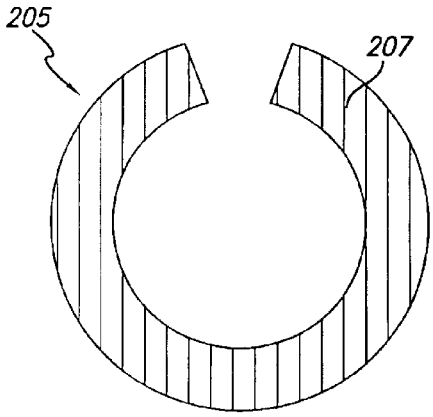

FIG. 36 is similar to that of FIG. 35 but with the stamper rotated 90 degrees with respect to the sheet of material.

Figure 37:
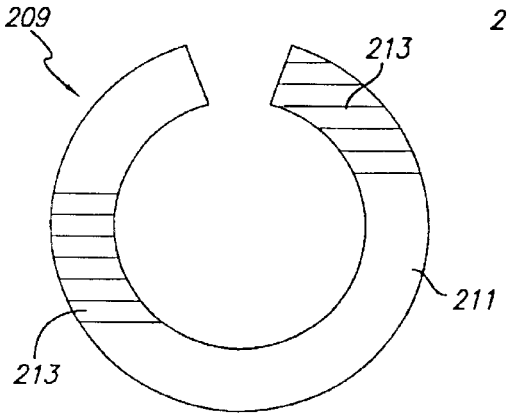

FIG. 37 shows an annular link element 209 having segments 213 of the major surface 211 serrated. This is made possible by fabricating the stamper tooling device with a serrated inner surface having the same pattern in reverse. Tf a pre-textured sheet of material is to be provided, it could not have continuous serrations, similar to the situation described in connection with FIG. 14.

Figure 38:
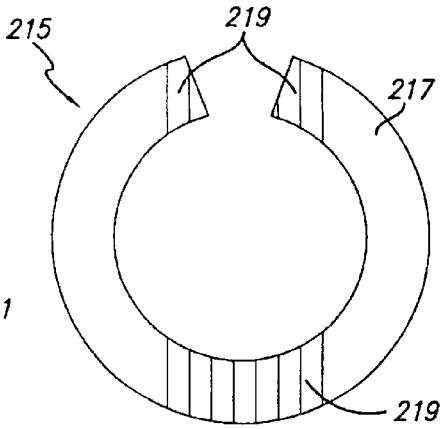

FIG. 38 shows an annular link element 215 having segments 219 of the major surface 217 serrated. This also is made possible by fabricating the stamper tooling device with a serrated inner surface having the same pattern in reverse. Preferably, however, a pre-textured sheet of material will be provided having an elongated center region of continuous serrations, and the stamper is simply oriented with the gap position aligned with the extent of the serrations.

Figure 39:
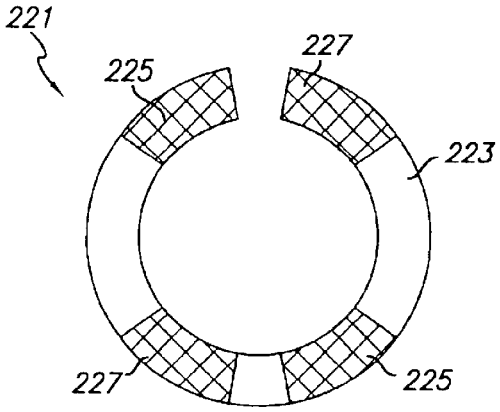

FIG. 39 shows an annular link element 221 having segments 225, 227 of the major surface 223 provided with a knurled effect. This is made possible by fabricating the stamper tooling device with a knurled inner surface having the same pattern in reverse. If a pre-textured sheet of material is to be provided, it could not have a continuous knurled pattern, similar to the situation described in connection with FIG. 14.

Figure 40:
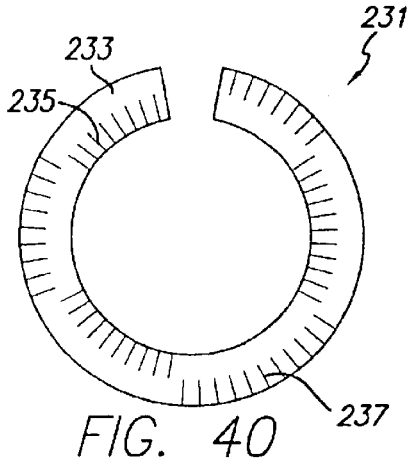
FIG. 40 is a plan view of a link element showing a major surface with alternating and spaced lining adjacent the interior and exterior edges, the lining being in the form of depressions formed during the stamping process.

FIG. 40 shows an annular link element 231 having segments 235, 237 of the major surface 233 lined, simulating scoring of the major surface 233. This is made possible by fabricating the stamper tooling device with a lined pattern on its inner surface of similar, but reversed, design.

Figure 41:
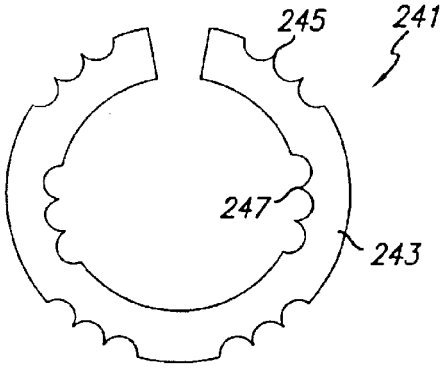
FIG. 41 is a plan view of a link element showing cutout patterns along the interior and exterior peripheral edges, formed during the stamping process.

FIG. 41 shows an annular link element 241 having segments 245, 247 of the major surface 243 notched. This is made possible by fabricating the stamper tooling device with a complementary notched cutting edge.

Figure 42:
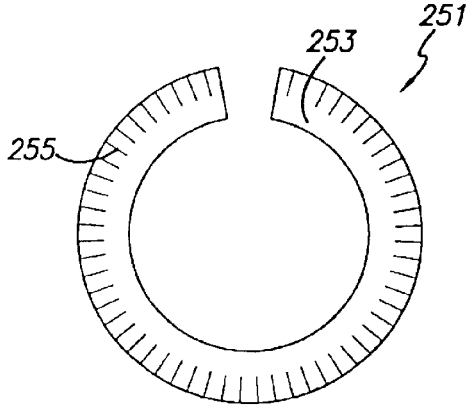
FIG. 42 is a plan view of a link element showing a major facial surface with evenly distributed lining adjacent the exterior edge, formed during the stamping process.

FIG. 42 shows an annular link element 251 having the outer extent of the major surface 253 provided with lining 255 simulating scoring of the major surface 253. This is made possible by fabricating the stamper tooling device with a lined inner surface having the same pattern in reverse.

Figure 43:
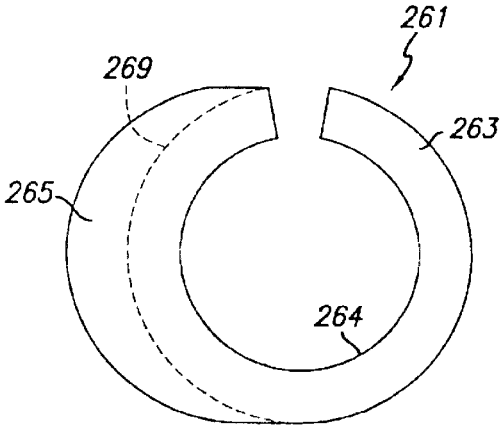
FIG. 43 is a plan view of a link element showing a configuration departing from the standard annular configuration and formed by stamping.

FIG. 43 shows a stamped link element 261 with a lobbed side 265. The dotted line 269 is the outline of a side that the link element would take if it were annular, like the other side 263, and is provided for comparison purposes only. Employing a number of link elements 261 in a rope chain, and with proper arrangement, produces one of the helixes having a larger effective diameter that the other helix.

Figure 44:
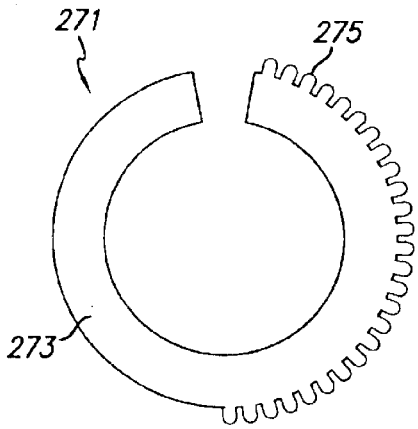
FIG. 44 is a plan view of a link element showing a configuration departing from the standard annular configuration, one half with beads formed along the exterior side thereof, all formed during the stamping process.

FIG. 44 shows an annular link element 271 having a smooth major surface 273, and with one half the exterior edge 275 beaded. This is made possible by providing the stamper tooling device with a beaded pattern along one half of its cutting edge.

Figure 45:
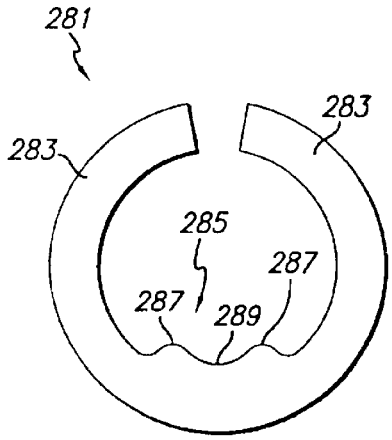
FIGS. 45–48 are a plan views of link elements each having a configuration departing from the standard annular configuration and formed by stamping.

FIG. 45 is a plan view of a link element 281 similar to that shown in FIG. 1, but with a double bumped protruding projection 285 on the interior edge thereof opposite the position of the gap in the link element 281 between the two halves 283. The two projecting bumps 287 define a depression 289. The link width of the arms of the two halves 283 is preferably narrower than standard. If the entire annular link element 281 had a less-than-standard width, the finished rope chain would be very loosely interconnected and unattractive. The purpose of the double bumped projection 285 is to simulate, during the assembly process, a link element of appropriate, i.e. standard, annular width at depression 285. Since the looseness or tightness of the finished rope chain product is dependent, among other factors, upon the width of the link at the location opposite the gap, employing the reduced material design for the link element 281 as shown will result in a perfectly formed rope chain with tightly interconnected link elements having the same flexibility as if the link elements were each made with a standard annular width in its entirety. This arrangement thus reduces material by a reduced annular width and by using fewer link elements per unit length of rope chain, making the chain to appear longer than the standard rope chain.

The purpose for the two spaced bumps 287 is to affect the appearance of the channels between rope strands of a finished rope chain. Due to the spaced bumps, the rope chain will display more precious metal (e.g., gold) in the channels between strands of the finished rope chain. As to construction concerns, the interior edge of a like adjacent link element 281 will fit perfectly within the depression 289, and the rope chain will have high structural integrity due to the width of the link element 281 between the exterior edge and the depression 289 being of standard dimension.

If desired, the arms 283 of link element 281 may be of standard width, and the edge projection 285 will then be of greater than standard width. In such a case, the gap will necessarily have to be widened to accommodate the projection 285 of an interconnected link since such projection passes through the open gap at an angle so as to have the major surfaces of adjacent link elements in surface contact. One advantage of this variation is that fewer link elements are necessary per unit length of rope chain.

Figure 46:
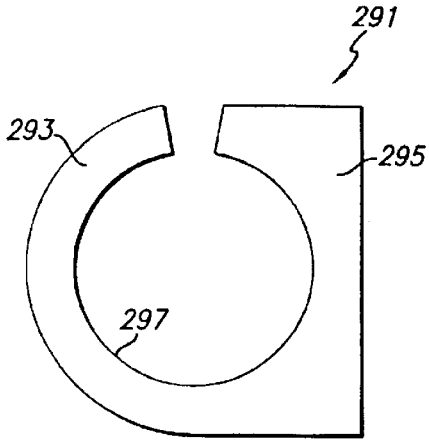

FIG. 46 shows a stamped annular link element 291 having a standard width annular shaped side arm 293 and a rectangular side arm 295. The overall configuration is D-shaped with a circular interior edge 297.

Figure 47:
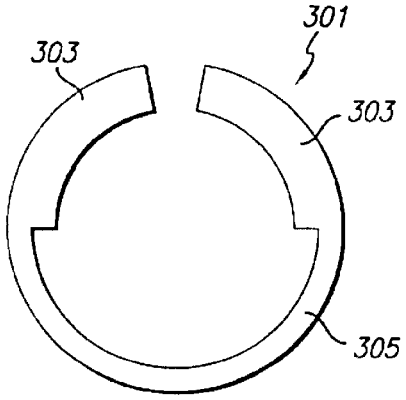

FIG. 47 shows a stamped annular link element 301 having a standard width annular shaped top half 303 and a less than standard annular width lower half 305.

Figure 48:
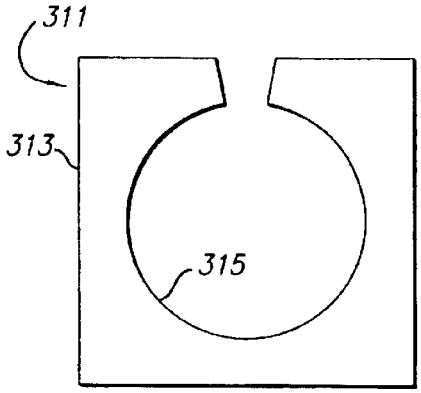

FIG. 48 shows a stamped annular link element 311 having a rectangular exterior edge 313 and a circular interior edge 315.

FIG. 49 shows a layered link element 321 having a yellow gold outer layer 323 and a white gold inner layer 325, the link element 321 being fabricated employing the method described in connection with FIGS. 18 and 30.

As with the embodiment of the multilayered sheet of material shown in FIG. 18, if desired, rather than two different materials or distinctly differently colored materials being laminated together, the inner layer 325 of link element 321 may be made of a yellow gold of relatively low gold karat weight, e.g. 7 karat gold, while the outer layer 323 may be made of a relatively high gold karat weight, e.g. 14 karat gold. In this manner, the visual impression of a finished rope chain will be essentially that of a 14K gold rope chain, giving a purchaser the desired visual quality at lower cost.

Figure 50:
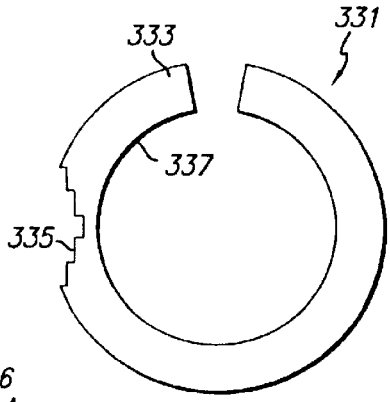
FIG. 50 is a plan view of a link element having a smooth interior edge and a stepped cutout on one side exterior edge.

FIG. 49A shows a layered link element 322 formed of two layers 324 and 326 and having a yellow gold major surface 328 and a white gold major surface 340, the link element 322 being fabricated employing the method described in connection with FIGS. 18 and 30. In FIG. 49A, each major surface 328, 340 exhibits a single color or texture, and the inner and outer edges (inner edge not visible in FIG. 49A) exhibit multiple colors or textures;

FIG. 50 is a plan view of a link element 331 having an arcuate, but stepped, concave cutout 335. This may create an interesting multi-faceted helix along one of the intertwining rope strands, which is especially attractive, especially when the flat stepped surfaces are rhodium coated. A multi-faceted helix on one of the intertwining rope strands is made possible by reversing every other link element in the assembly procedure. However if both sides of link element 331 are symmetrically concave and stepped as shown, a helical groove can be seen on top of each simulated helical rope strand without having to reverse every other link element.

Figure 51:
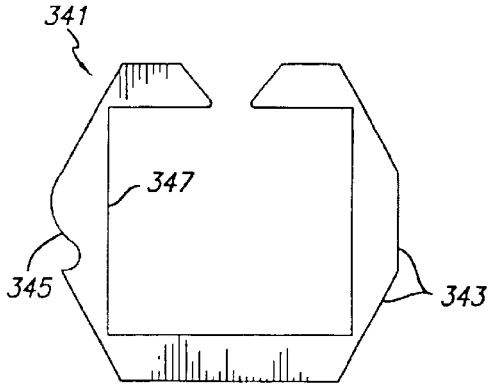
FIGS. 51–59 are plan views of link elements each having a shaped configuration departing from the standard annular configuration and formed by stamping, FIGS. 53, 55, and 56 showing all or a portion of the link element as a series of adjacently connected geometric or design shapes.

FIG. 51 shows a stamped annular link element 341 having a polygonal exterior edge 343, a square interior edge 347, and a fanciful cutout design 345 on one side arm.

Figure 52:
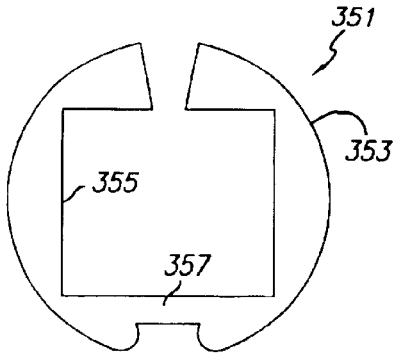

FIG. 52 shows a stamped annular link element 351 having a circular exterior edge 353, a square interior edge 355, and a cutout region 357 opposite the location of the gap in the link element 351.

Figure 53:
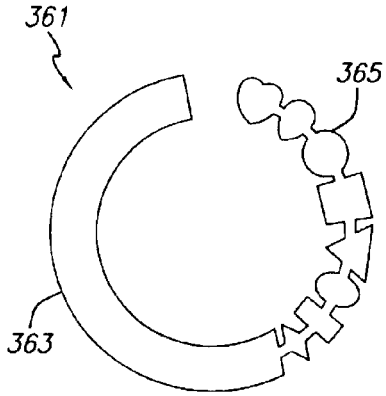

FIG. 53 shows a stamped annular link element 361 having a standard width annular side arm 363 and a series of symbols cut out on the other side arm 365. The symbols may be of any desired design and need be connected only with enough precious metal for strength and durability, so as not to obscure the nature of the design of the symbols. This is another example of significant savings in precious metal with the synergistic effect of enhancing the decorative value of the piece of jewelry from which it is constructed.

Figure 54:
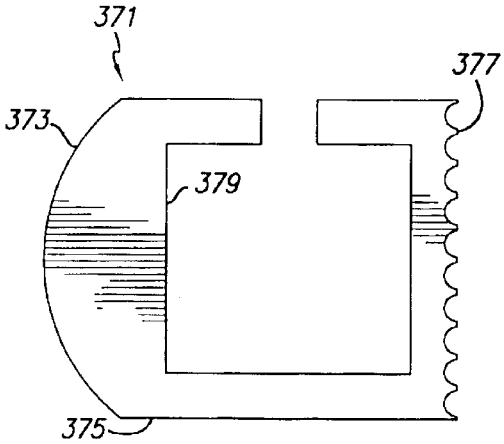

FIG. 54 shows a stamped annular link element 371 having a generally D-shaped exterior edge 373, a square interior edge 379, and an undulated exterior edge 377 on one of its side arms.

Figure 55:
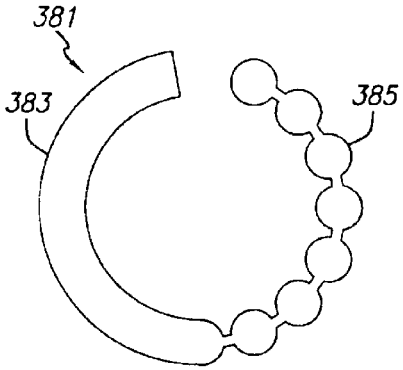

FIG. 55 shows a stamped annular link element 381 having a standard width annular side arm 383 and a series of circular symbols cut out on the other side arm 385.

Figure 56:
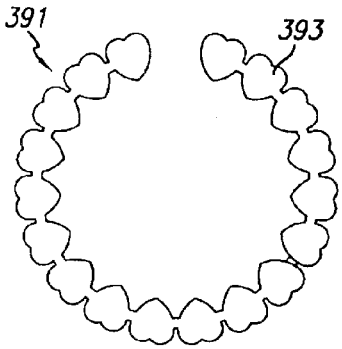

FIG. 56 shows a stamped annular link element 391 having an average standard annular width but with the entire extent of the link element 391 formed with an interconnected series of heart symbols 393.

Figure 57:
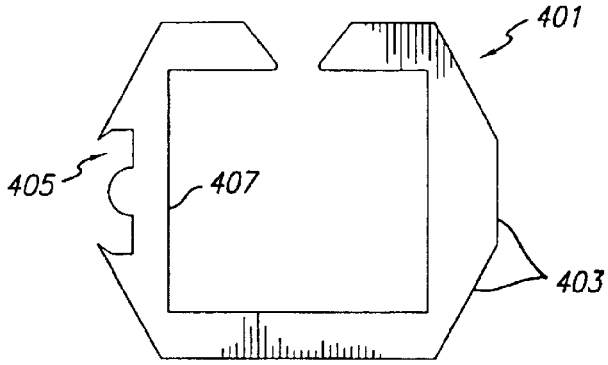

FIG. 57 shows a stamped annular link element 401 having a polygonal exterior edge 403, a square interior edge 407, and a fanciful cutout design 405 on one side arm.

Figure 58:
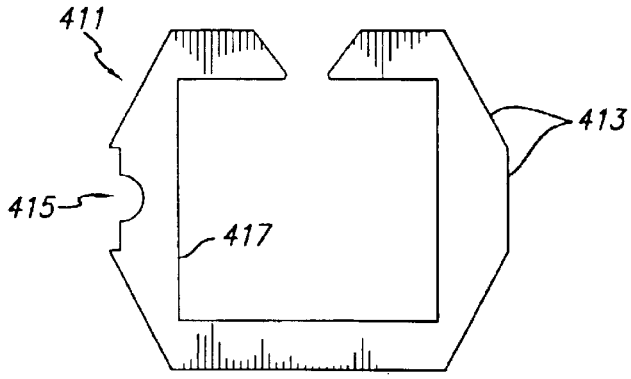

FIG. 58 shows a stamped annular link element 411 having a polygonal exterior edge 413, a square interior edge 417, and a fanciful cutout design 415 on one side arm.

Figure 59:
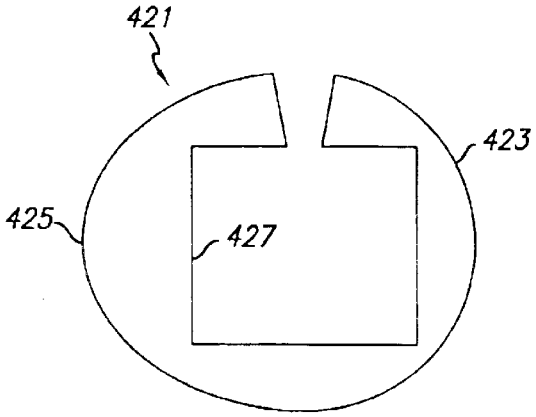

FIG. 59 shows a stamped annular link element 421 having an egg shaped exterior edge with a circular portion 423 and an oval portion 425, and a square interior edge 427.

Figure 60:
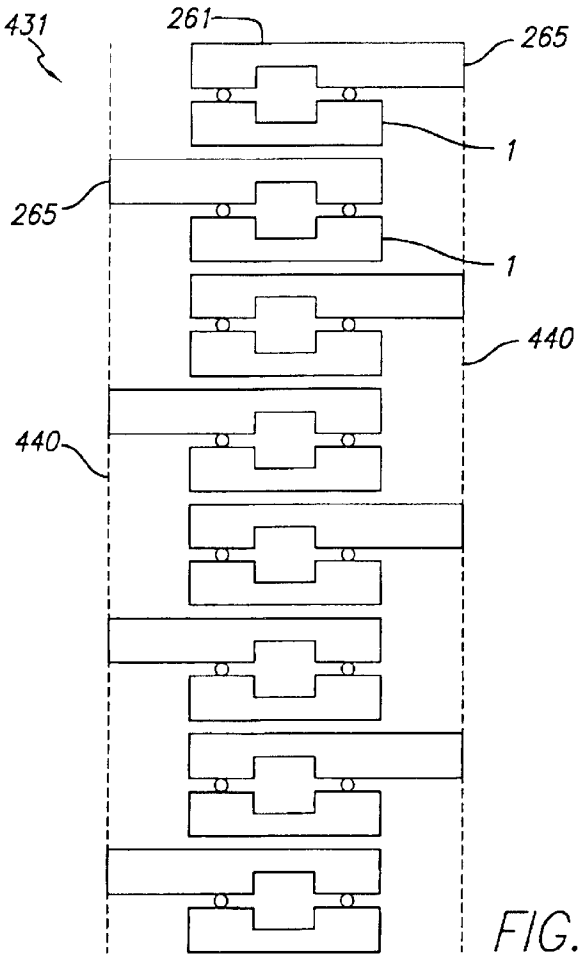
FIG. 60 is a schematic representation showing the assembly sequence of link elements forming a length of rope chain, employing link elements of standard, or substandard, annular widths alternating with link elements having a portion relatively enlarged in annular width such as that shown in FIG. 43.

FIG. 60 represents, schematically, an example of assembling a rope chain 431 by alternating link elements 261 (FIG. 43) having lobbed sides 265 with conventionally shaped annular link elements 1 (FIG. 1). The lobbed side 265 of the sequence of link elements 261 are placed alternately opposite one another, thereby producing a length of rope chain having the appearance of a larger overall diameter as indicated by dashed lines 440.

Figure 61:
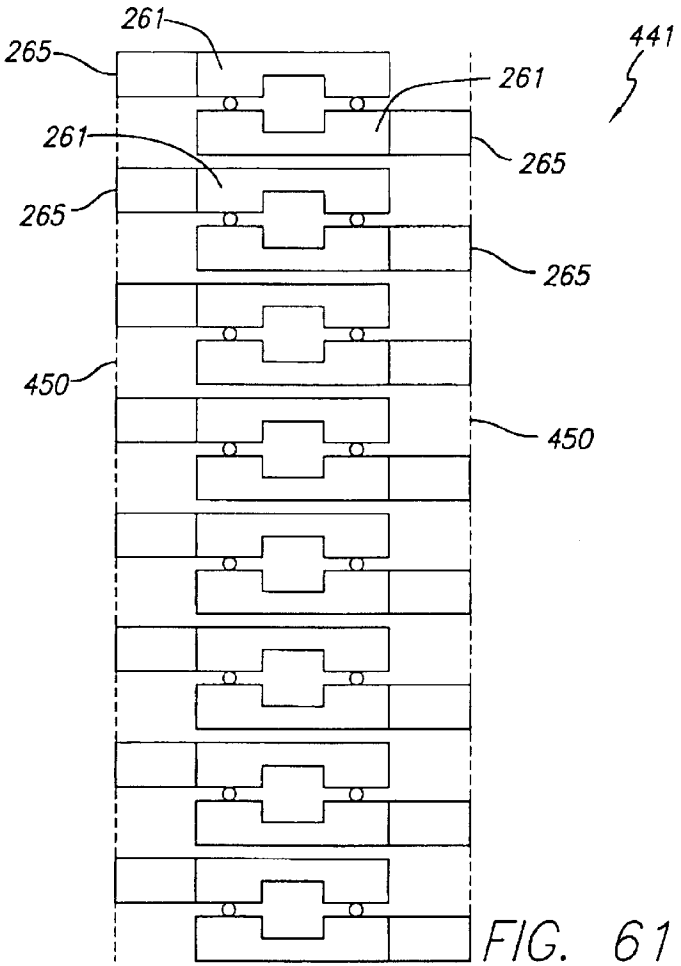
FIG. 61 is a schematic representation showing the assembly sequence of link elements forming a length of rope chain, employing link elements each having a portion relatively enlarged in annular width such as that shown in FIG. 43.

FIG. 61 is a schematic representation of an arrangement for a rope chain 441, whereby only link elements 261 with lobbed sides 265 are used with consecutive link elements 261 placed such that the lobbed sides 265 alternate in opposite orientation, thereby producing a length of rope chain having the appearance of a larger overall diameter as indicated by dashed lines 450.

Figure 62:
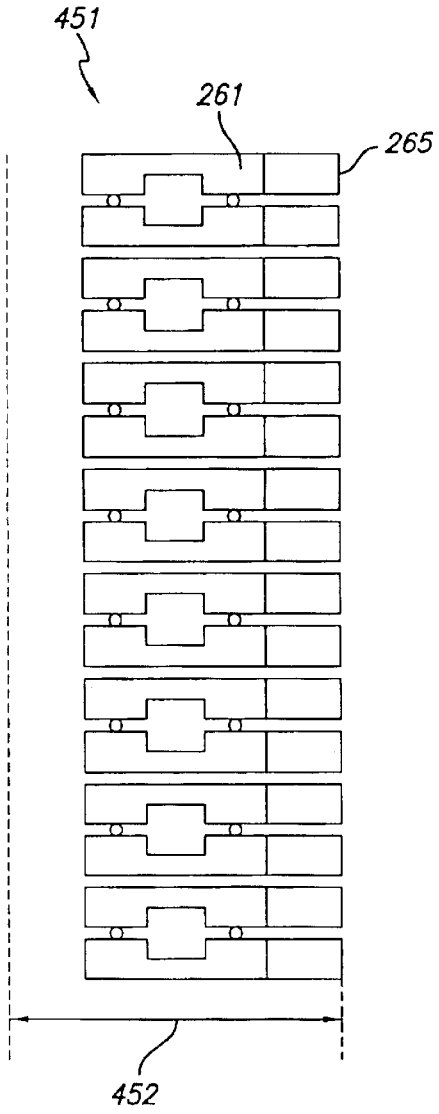
FIG. 62 is a schematic representation showing the assembly sequence of link elements forming a length of rope chain, employing aligned link elements each having a portion relatively enlarged in annular width such as that shown in FIG. 43.

FIG. 62 is a schematic representation of an arrangement for a rope chain 451, whereby only link elements 261 with lobbed sides 265 are used but with consecutive link elements 261 placed such that the lobbed sides 265 are in the same general orientation. Since the finished rope chain 451 will have a helical character, visually the rope chain 451 has an apparent larger diameter as indicated at 452.

Figure 63:
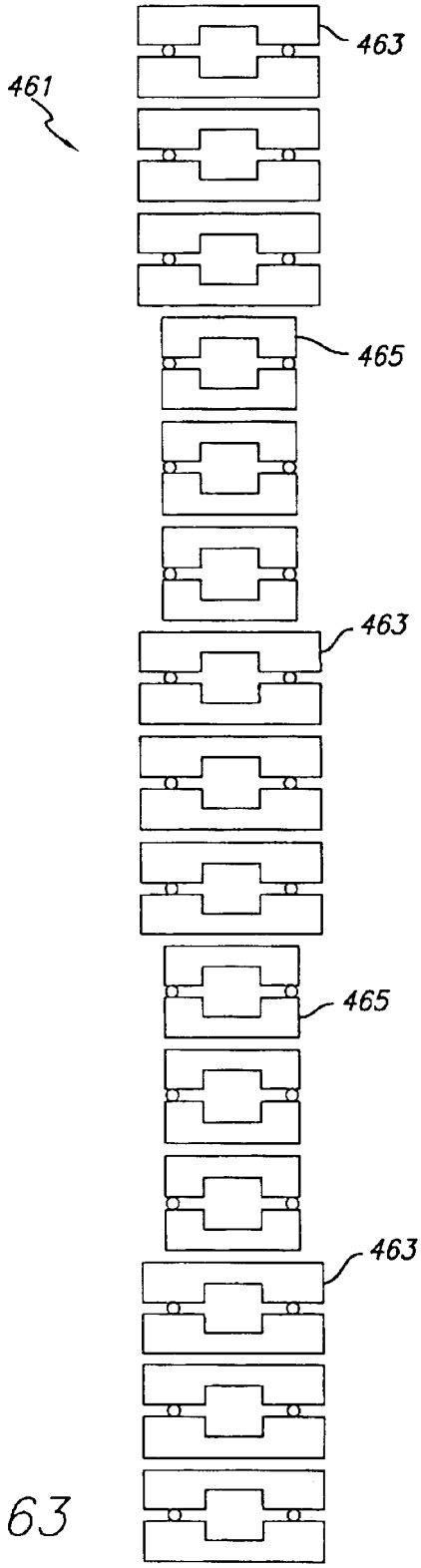
FIG. 63 is a schematic representation showing the assembly sequence of link elements forming a length of rope chain, employing link elements, whether annularly shaped or otherwise, of different dimensions alternating every six link elements.
Figure 64:
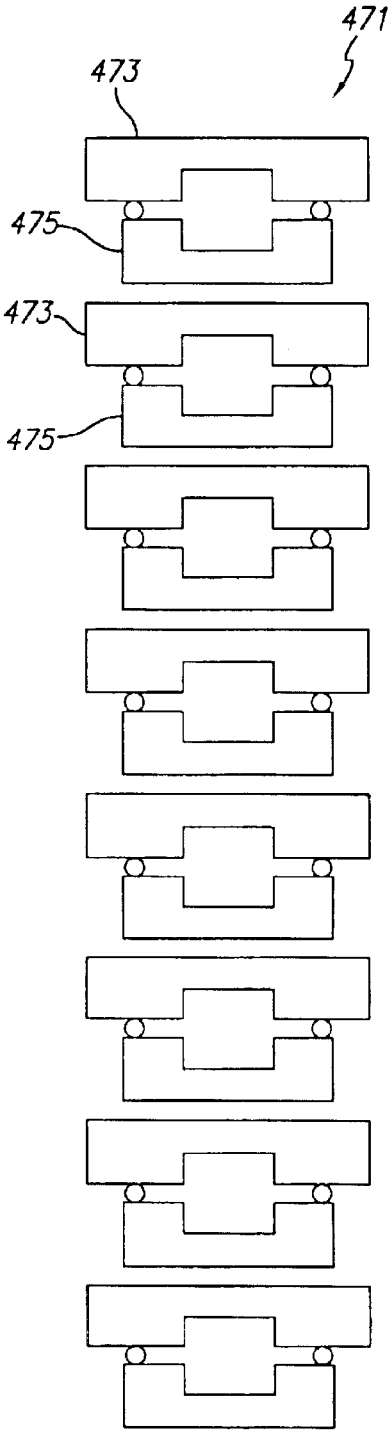
FIG. 64 is a schematic representation showing the assembly sequence of link elements forming a length of rope chain, employing link elements of standard, or substandard, annular widths alternating with link elements having relatively enlarged annular widths.

FIGS. 63–65 schematically illustrate how link elements, whether annularly shaped or otherwise, of different dimensions can be interconnected together to form a rope chain resulting in a chain of different diameters along the length of the chain. This type of arrangement, in addition to its resulting distinctive appearance, can also contribute to savings in material costs, and yet the overall effect renders a visual effective diameter equal to that of the larger diameter link elements.

FIG. 63 shows a chain 461 comprised of link elements 463, 465 of different dimensions every six link elements.

FIG. 64 shows a chain 471 in which every other link element 473 is of the same dimension and is interspersed with every other link element 475 of a different dimension. The overall outline of this chain would give the general appearance of a chain made only from the link elements of larger dimension.

FIG. 65 illustrates a chain 481 in which every two consecutive link elements 483 and 485 are of a different diameter.

The illustrations in FIGS. 60–65 are presented for exemplary purposes only. The visual properties and the arrangements can be varied depending on the desired effect.

Figure 66:
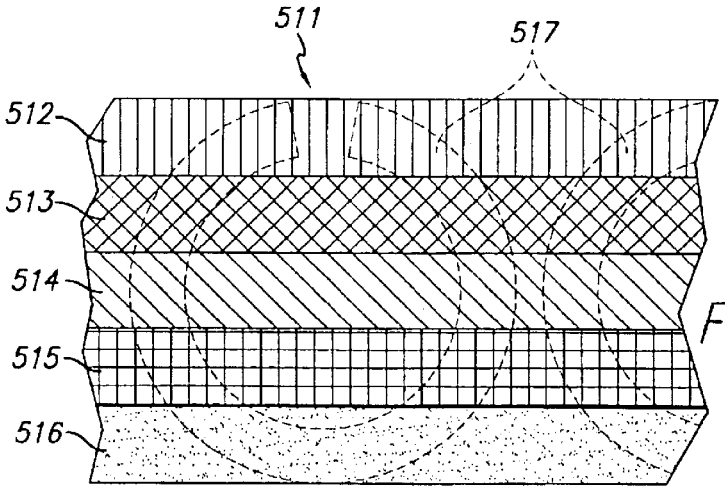
FIG. 66 is a plan view of a sheet of material having multiple colored or textured regions, thereby exhibiting five different visual properties, and, in dashed lines, the location and orientation of link elements to be stamped from such sheet of material.

FIG. 66 is a plan view of a sheet of material 511 having multiple colored or textured regions 512–516, thereby exhibiting five different visual properties, and, in dashed lines, the location and orientation of link elements 517 to be stamped from such sheet of material 511.

Figure 67:
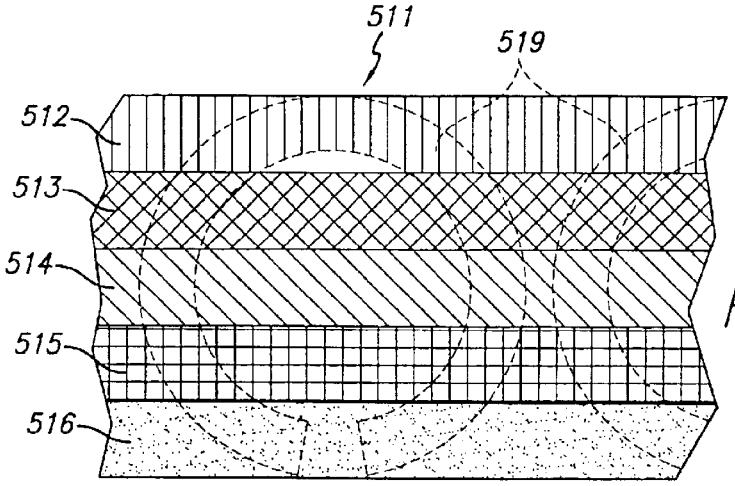
FIG. 67 is a plan view similar to that of FIG. 66, but with the orientation of link elements rotated 180°.

FIG. 67 is a plan view similar to that of FIG. 66, but with the orientation of link elements 519 rotated 180°.

Figure 68:
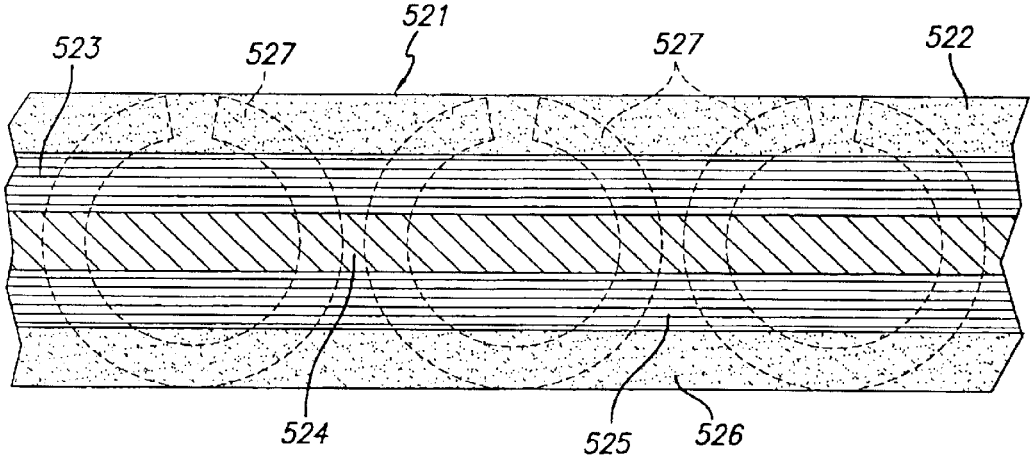
FIG. 68 is a plan view of a sheet of material having multiple colored or textured regions, thereby exhibiting five different visual properties, and, in dashed lines, the location and orientation of link elements to be stamped from such sheet of material.

FIG. 68 is a plan view of a sheet of material 521 having multiple colored or textured regions 522–526, thereby exhibiting five different visual properties, and, in dashed lines, the location and orientation of link elements 527 to be stamped from such sheet of material 521.

FIG. 69 is a fragment representation of the sheet of material 511 shown in FIG. 66 or 67. The sheet of material 511 has five different strips of material 512–516, and the figure lining is not intended to represent any particular color or texture which may be selected from any of the colors or textures described in this specification. It is to be noted that every other link element of a rope chain is inverted, i.e., if the gap of a particular link element is oriented upwardly, the gap of each adjacent link element will be oriented downwardly. For this reason, a rope chain constructed of elements 517 would be uninteresting because there would be no color/texture pattern correlation link-to-link. That is, on one link element the visual properties top-to-bottom would be in the order 512–516, while on each adjacent link element the visual properties top-to-bottom would be in reverse order of 516–512.

However, if the sheet of material 511, or the stamping machine (not shown), were reversed in orientation, as shown in FIG. 67, with the link element 519 possessing the same coloring/texturing but in reverse order relative to the gap position, then an assembled rope chain will have color/texture pattern correlation link-to-link, and will display a plurality of helical color/texture patterns along the rope chain 531. This is shown in FIG. 70 in the lower segment "B". Segment "B" is comprised of alternate link elements 517 and 519, with the fragment of FIG. 6 aligned with link element 520 as a reference.

In addition to multiple colored helixes, as described above, it will be noted that in segment "B", one side of each channel 535 has the color/texture of strip 512 (FIGS. 66, 67), while the other side of each channel 535 has the color/texture of strip 516. Color/texture 514 creates a thin helical stripe along the extreme periphery of each strand the rope chain 531.

Instead of manufacturing two different, oppositely patterned, multicolored link elements 517 and 519, a length of rope chain can be made with link elements alternating with either link elements 517 or 519 and a standard single color link element, e.g., one of solid yellow gold. When assembled, the length of rope chain will have the appearance as shown in segment "A" of FIG. 70. With this arrangement, it is not necessary to have two different multi-colored or multi-textured link elements, and yet a plurality of helical color/texture patterns will be seen along the rope chain 531, the helical patterns interrupted by alternate solid yellow gold link elements. To some tastes, this more subtle helical patterning may be more appealing than the somewhat "busy" appearance of the helical patterning shown in segment "B".

FIG. 71 is a fragment representation of the sheet of material shown in FIG. 68. The sheet of material 511 has five different strips of material 522–526, and the lining is not intended to represent any particular color or texture which may be selected from any of the colors or textures described in this specification. It is to be noted that the color/texture pattern on sheet 521 is symmetrical, with strips 522 and 526 having the same color or texture, and strips 523 and 525 having the same color or texture but different than strips 522 and 526. Strip 524 is likewise of a different color or texture than any other strip.

Because of the symmetry of color/texture strips in sheet 521, there is no need to stamp out differently oriented link elements, since each link element 527 has the same color/texture pattern in both orientations of the gap. Thus, an assembled rope chain 536, shown in FIG. 72, will have color/texture pattern correlation link-to-link, and will display a plurality of helical color/texture patterns along the rope chain 536.

In addition to multiple colored helixes, as described above, it will be noted that in FIG. 72, both sides of each channel 537 has the color/texture of strips 522 and 526 (FIG. 68). Color/texture 524 creates a thin helical stripe along the extreme periphery of each strand the rope chain 536. In the embodiments shown in FIGS. 66–72, five strips of materials, colors, and/or textures are shown, but any other number of strips can make up the multiple strip sheets 511 and 521. Further, while it has been suggested that any of the strips 512–516 and 522–526 can be different materials, different colors, and/or different textures, when different textures are selected for certain strips, the textured strips should alternate with non-textured strips. If all strips, or adjacent strips, were textured, even with different types of textures, the distinction between different textures will be difficult to see and appreciate. Additionally, while the orientations of the stamped link elements shown in FIGS. 66–68 are such that the gaps are at 12:00 o'clock and 6:00 o'clock positions, any angular orientation is easily achieved by rotating the stamping die or the sheet of material being stamped, therefore producing link elements exhibiting an unlimited number of different patterns. Following the above methods of assembling multiple patterned link elements, the visual appearance of rope chains manufactured using such multiple patterned link elements will be self evident to a person of ordinary skill in the art.

FIG. 73 is a plan view of a segment of a sheet of material having multiple colored or textured regions 542–546 similar to that of FIGS. 66, 67, and 69. However, only every fifth link element 549 in the rope chain shown in FIG. 74 is stamped from sheet 541. A second sheet (not shown) having the same color/texture patterns as sheet 541 but shifted laterally by one color/texture strip width is stamped to produce link elements 551, also spaced every fifth link element position, and placed adjacent link elements 549 made from sheet 541. Similarly, a third sheet (not shown) having the same patterns but shifted another color/texture strip width is stamped to produce link elements 553, also spaced every fifth link element position, and placed adjacent link elements 551. Link elements 549, 551, and 553 are shown in FIG. 75 oriented with their gaps alternating from 12:00 o'clock to 6:00 o'clock as they would be in the assembly process. Another two sets of link elements (not shown) are stamped from another two separate sheets each having the color/texture pattern 542–546 shifted an additional strip width. These additional two sets of link elements complete the five sets of distinctively color/texture striped link elements need to produce the rope chain shown in FIG. 74. It is not necessary to show the color/texture patterns of the latter two link element sets in FIG. 74, since their color/texture patterns and orientation are self-evident from the description of the first three link elements 549, 551, and 553.

The net result of assembling five different sets of link elements just described is a rope chain 547 which exhibits a pleasing and surprisingly unique repeated pattern of laterally striped color/texture segments, as illustrated in FIG. 74. As will be understood by reference to FIG. 75, rather than manufacturing five different multi-striped sheets of material from which to stamp out the five differently striped link elements 549, 551, 553, etc. (only three are shown), a single sheet of material (not shown) having nine strips in the order 1-2-3-4-5-1-2-3-4, representing the five different colors/textures, can be manufactured and stamped to produce all five different link elements from the same sheet to construct rope chain 547. However, considerable waste of precious metal would be involved, and the decision as to how many sheets of how many color/texture strips is left to the discretion of the manufacturer.

FIG. 76 is a plan view of a sheet of material 561 from which curved slices 563 can be cut and eventually formed into link elements. The purpose for this methodology is to minimize or completely eliminate cracking and stress blemishes that may result in curling a straight piece of precious metal into a "C" shaped link element (cf. FIG. 30). By starting with a partially curved stamped slice of material, less bending is needed. Of course, some small amount of waste in the regions 567, due to forming flat ends 565 on the link element slices 563, will be realized, but this may be more than offset by the savings in damaged link elements made from straight wires or slices.

FIG. 77 is a plan view of a sheet of material 571 from which link elements 573 and 575 can be stamped, the link elements being interlinked in layout and alternating in their respective gap positions 577, 579. Shapes other than square are obviously possible using this stamping technique, and the sheet of material 571 optionally can be multi-colored or multi-textured similar to those shown in FIGS. 66–68, 69, 71, and 73. Depending upon the shape of the link elements desired, and the gap width needed, layouts different than that shown in FIG. 77 will be self-evident to a person of ordinary skill in the art. Interlinking in the manner shown and described serves to minimize material waste.

It will be understood that, when link elements have specific edge designs or patterns, such as those shown in FIGS. 53–56, it may be preferable to not place them against one another. Otherwise, the designs or patterns will be covered up by adjacent link elements. A number of thinner than standard link elements (not shown) are perfectly suited for spacing out the aforementioned link elements having edge designs or patterns.

Additionally, it is known to diamond cut the edges of a completed rope chain and coat, with rhodium or other material, the flattened surfaces created by the diamond cutting process. By constructing a rope chain using, in part or in whole, serrated, scored, or knurled, link elements, and subsequently rhodium coating diamond cut surfaces, a dramatic increase in contrast is seen due to the softer yellow gold color of the serrated, scored, or knurled portions and the mirror-like finish of the coated diamond cut portions of the chain. Diamond cutting techniques can be easily adapted to the methods of the present invention, especially for those embodiments in which a sheet of material is pre-textured prior to stamping out link elements therefrom.

As has been suggested by the various embodiments and variations of the invention presented herein, the flexibility of design, appearance, and feel of a rope chain manufactured using the link elements shown and described can stimulate a myriad of possibilities. These attributes of a completed rope chain can be unique with the present invention. Creating similar attributes using prior art techniques would not be considered by the person of ordinary skill in the art, since all attempts to similarly shape, color, texture, or pattern a rope chain after it is completed would not be practical. The uniqueness of a rope chain employing the link elements of the present invention is made possible by the provision of forming, shaping, or otherwise processing individual link elements prior to assembly. Exclusive finished rope chain attributes made possible with the present invention cannot be duplicated by applying post-assembled processing steps, whether a single type link element is used throughout the length of the rope chain, or multiple types of link elements are assembled in a particular or random order.

As suggested herein, any visual property, as defined herein, may be combined with any one or more other visual properties in the manufacture of the various link elements making up the completed rope chain. Visual properties of any one portion of a link element, or the rope chain or a helical strand thereof, may include at least one of the group consisting of color, material, different gold karat weights, texture, shape, reflectivity, pattern, size, and design.

As previously mentioned, one object of the invention is to reduce the amount of material making up the individual link elements to reduce manufacturing costs, while not detracting from the beauty and effective size (diameter) of the finished rope chain. Reducing material can be accomplished in many ways: by removing material from or forming edge depressions in the entire or portions of the exterior edge; by removing material from or forming edge depressions in the entire or portions of the interior edge; by removing material from or forming surface depressions in one or both major link surfaces; by forming openings in or through the major link surfaces; or otherwise narrowing the width of the entire or portions of the link elements. In some embodiments of the invention, part or all of a link element may have a link width larger than standard but with openings provided therein to result in a net reduction of material making up the link element.

Link thickness, as used herein, is defined as a distance between and perpendicular to the plane of the first and second major surfaces, and at least some of the link elements in a rope chain may have an irregular link thickness along the extent of the link element. Link elements have been described herein that possess irregular link thicknesses along the extent of the link elements due to impressions or the formation of surface texturing. Such link elements that bear surface ornamentation on each link element will cause a rope chain to have a more decorative design than the conventional rope chain and yet use less precious metal than a standard link element without such irregular link thickness.

The embodiments of the invention shown in the figures provide a basis for appreciating the virtually limitless number of configurations and shape and design patterns that can be produced in a rope chain structure by employing and creatively arranging the differently colored, patterned, textured, and/or shaped link elements such as those depicted in the accompanying drawings. Further variations and combinations of color patterns, textures, shapes, and configurations are possible and presumed to be within the teaching of the present invention.

Obviously, color, shape, texture, and overall configurations other than those shown in the accompanying figures are possible for the manufacture of the link elements, and these are merely examples of preferred visual property combinations which can produce striking results in a finished rope chain construction. For example, an interesting variation of an undulated shaped edge would be a scalloped edge. Accordingly, it is to be understood that the shape and design patterns shown in the accompanying figures, the types of materials used, the coloring, surface texture, surface patterns, arrangement of groups and sets of link elements along the rope chain, reversed or not, randomly assembled or in strict accordance with a repeated pattern, and the like are all contemplated possibilities and are to be considered within the scope of the present invention.

While only certain embodiments have been set forth, alternative embodiments and various modifications will be apparent from the above description to those skilled in the art. For example, while the colors and precious metals used in the descriptions herein are preferred to be yellow, white, rose, and green gold, other colors and metals, or even nonmetals, can be employed in the construction of the disclosed rope chain configurations. Notable alternate materials, for example, are rhodium (in various colors), silver, and nickel, either solid or plated. Colored coatings may also be applied, such as enamel or powder coating.

Several references to rhodium coating have been made in this description. It is to be understood that virtually any part of a finished rope chain, constructed from any of the link elements shown in the accompanying figures can be rhodium or gold plated, or coated with any other preferred material or substance. Alternatively, if a rope chain is made without the application of heat to weld, or otherwise attach, adjacent link elements together, rhodium (or other material or substance) coating can be applied to the individual link elements prior to assembly, saving much labor expense which would otherwise be required with post assembly coating processes.

Rhodium, gold, or other precious metal plating may be applied by a variety of commonly known plating equipment and processes. For methods and equipment to plate assembled rope chains, reference is made to Pro-Craft® Pen Platers, No. 45.400 and No. 45.403 available from Gorbet USA® Tools, Supplies and Equipment for Technicians and Craftsmen, through NK Supply, Inc. Jewelry Supplies 608 S. Hill St. Suite 602, Los Angeles, Calif. 90014. These pen platers can use formulated pen plating solutions, also available from Gorbet USA®, such as Gorbet USA® No. 45.414 Pro-Craft® plating solution, for plating rhodium. Other pen plating solutions are available for plating metals other than rhodium plating solutions. For example Gorbet USA® Nos. 45.410 through 45.412 are Pro-Craft® gold plating solutions, and No. 45.415 is a Pro-Craft® black rhodium plating solution.

Another method for plating rhodium, gold, or other precious metal on only one helical rope strand, or to selected portions, of an assembled rope chain plating involves three major steps: protective coating all areas of an assembled rope chain that are not to be plated; immersing the partially protected chain in a plating bath (e.g., an electro-plating bath); and removing the protective coating. This results in a chain having some non-plated areas (that were protected) and some plated areas added by the plating process. This method is a widely known and therefore does not warrant listing sources for plating materials or plating equipment.

In lieu of rhodium or gold plating, the link elements, prior to assembly, and/or the exterior surface, or portions of the exterior surface, of one or both rope strands of an assembled length of rope chain can be colorized by a blackener process, by an oxidizer process, or by applying and curing a hard colored enamel. The above-mentioned Gorbet USA® source supplies Jax® Blackeners such as No. 45.906, Vigor® Oxidizers such as No. 45.0329, and Ceramit™ low temperature curing, hard enamels such as No. 45.800.

All of the above-mentioned plating, blackening, oxidizing, and enameling process result in either a visually attractive color coordinated length of rope chain, or a rope chain in which the different colors exhibited are in much greater contrast than conventional rope chains without any post assembly surface colorization.

It will also be understood that, for all of the link elements described herein in which segments of a link element have different link widths, either the relatively smaller or relatively larger, segment may be of standard size.

In the examples herein showing segmented link elements with one side having different physical characteristics than the other side, the drawings and accompanying text referred to the transition being opposite the placement of the gap. It is within the scope of the present invention to provide segmented regions having different physical characteristics or properties as described herein placed in other positions along the extent of the link elements. One example is providing a dividing line horizontally positioned in any of the accompanying figures. These and other alternatives are considered equivalents and within the spirit and scope of the present invention.

What is claimed is:

1. A jewelry rope chain link element of the type that is assembled with other link elements to form a rope chain, each of said link elements being generally C-shaped in configuration to define a gap between facing ends thereof, said link element comprising:

a first major surface;

an opposite second major surface;

an interior edge; and an exterior edge, wherein:

said C-shaped link element is made of a material exhibiting a plurality of regions, adjacent ones of which exhibit different visual properties, the link element comprising segments of a least two of said plurality of regions;

said C-shaped link element is provided with variably selectable multiple segments of different visual properties;

said C-shaped link element has a geometric center;

said gap has a center midway between said facing ends;

said regions exhibiting different visual properties are elongated regions adjoined along longitudinal side edges thereof; and a line extending from said link center through said gap center is parallel to the longitudinal edges of said elongated regions.

2. A jewelry rope chain link element of the type that is assembled with other link elements to form a rope chain, each of said link elements being generally C-shaped in configuration to define a gap between facing ends thereof, said link element comprising:

a first major surface;

an opposite second major surface;

an interior edge; and an exterior edge, wherein:

said C-shaped link element is made of a material exhibiting a plurality of regions, adjacent ones of which exhibit different visual properties, the link element comprising segments of a least two of said plurality of regions;

said C-shaped link element is provided with variably selectable multiple segments of different visual properties;

said C-shaped link has a geometric center;

said gap has a center midway between said facing ends;

said regions exhibiting different visual properties are elongated regions adjoined along longitudinal side edges thereof; and a line extending from said link center through said gap center lies non-parallel to the longitudinal edges of said elongated regions.

3. The link element as claimed in claim 2, wherein a line extending from said link center through said gap center lies perpendicular to the longitudinal edges of said elongated regions.

4. A jewelry rope chain link element of the type that is assembled with other link elements to form a rope chain, each of said link elements being generally C-shaped in configuration to define a gap between facing ends thereof, said link element comprising:

a first major surface;

an opposite second major surface;

an interior edge;

an exterior edge; and voids formed therein, wherein said C-shaped link element has at least one of its major surfaces serrated and has at least one of its interior and exterior edges serrated.

5. A jewelry rope chain link element of the type that is assembled with other link elements to form a rope chain, each of said link elements being generally C-shaped in configuration to define a gap between facing ends thereof, said link element comprising:

a first major surface;

an opposite second major surface;

an interior edge;

an exterior edge; and voids formed therein, wherein:

at least a portion of at least one of its major surfaces is serrated; and at least a portion of said at least one major surface not serrated.

* * * * *